US007703184B2

(12) United States Patent
Meager

(10) Patent No.: US 7,703,184 B2
(45) Date of Patent: Apr. 27, 2010

(54) DEVICE FOR CREATING A SEAL BETWEEN FABRICS OR OTHER MATERIALS

(75) Inventor: Ben Meager, Bozeman, MT (US)

(73) Assignee: Gore Enterprise Holdings, Inc., Newark, DE (US)

( * ) Notice: Subject to any disclaimer, the term of this patent is extended or adjusted under 35 U.S.C. 154(b) by 0 days.

(21) Appl. No.: 12/250,147

(22) Filed: Oct. 13, 2008

(65) Prior Publication Data

US 2009/0089983 A1 Apr. 9, 2009

Related U.S. Application Data

(63) Continuation of application No. 11/258,655, filed on Oct. 25, 2005, now Pat. No. 7,451,530, which is a continuation-in-part of application No. 10/803,834, filed on Mar. 17, 2004, now Pat. No. 7,536,758, which is a continuation of application No. 10/135,881, filed on Apr. 29, 2002, now Pat. No. 6,721,999.

(60) Provisional application No. 60/622,191, filed on Oct. 25, 2004, provisional application No. 60/287,938, filed on Apr. 30, 2001.

(51) Int. Cl.
*A44B 19/24* (2006.01)
*A44B 19/26* (2006.01)
*A44B 19/28* (2006.01)

(52) U.S. Cl. ..... 24/399; 24/400; 24/417; 24/427; 24/428

(58) Field of Classification Search ..... None
See application file for complete search history.

(56) References Cited

U.S. PATENT DOCUMENTS

| | | | |
|---|---|---|---|
| 1,703,712 | A | 2/1929 | Aud |
| 1,706,097 | A | 3/1929 | Aud |
| 1,719,856 | A | 7/1929 | Sipe |
| 1,887,741 | A | 11/1932 | Trotter |
| 1,959,318 | A | 5/1934 | Sundback |
| 1,959,319 | A | 5/1934 | Sipe |
| 2,217,571 | A | 10/1940 | Susskind |
| 2,263,481 | A | 11/1941 | Austin |
| 2,353,858 | A | 7/1944 | Tedesco |

(Continued)

FOREIGN PATENT DOCUMENTS

| | | |
|---|---|---|
| BE | 514 547 | 10/1952 |

(Continued)

*Primary Examiner*—Jack W. Lavinder
(74) *Attorney, Agent, or Firm*—James Arnold, Jr.

(57) ABSTRACT

A device for forming a seal includes upper and lower seal members, and a slider, wherein mating surfaces of the seal members interlock. In at least one embodiment, a lifting rib and closure bar on the slider cooperate with a lifting wing and closure bar groove on the upper and lower seal members, respectively. By moving the slider in one direction, the lifting rib lifts the upper seal member from the lower seal member. Moving the slider in the opposite direction causes the upper and lower seal members to interlock. In another embodiment, a slider has an intermediate lateral member connected on one side the slider top, and connected on the other side to the slider bottom. A breakaway sealing device is also provided, allowing a person to break the closed seal. A beginning stop block is also provided that includes a means for securing the upper seal member.

6 Claims, 27 Drawing Sheets

U.S. PATENT DOCUMENTS

| | | | | |
|---|---|---|---|---|
| 2,355,816 | A | | 8/1944 | Morner |
| 2,491,524 | A | | 12/1949 | Siple |
| 2,506,965 | A | | 5/1950 | Morin |
| 2,507,445 | A | | 5/1950 | Krueger |
| 2,613,421 | A | | 10/1952 | Madsen |
| 2,652,611 | A | | 9/1953 | Jaster |
| 2,665,467 | A | | 1/1954 | Bosomworth et al. |
| 2,696,032 | A | | 12/1954 | Sander |
| 2,777,181 | A | | 1/1957 | Morner |
| 2,794,227 | A | | 6/1957 | Dorman |
| 2,797,463 | A | | 7/1957 | Dorman et al. |
| 2,810,944 | A | | 10/1957 | Sander |
| 2,869,207 | A | | 1/1959 | Berstein |
| 2,871,539 | A | | 2/1959 | Swan |
| 2,889,605 | A | | 6/1959 | Morin |
| 2,909,822 | A | | 10/1959 | Botti et al. |
| 2,941,027 | A | | 6/1960 | Svec |
| 2,978,769 | A | | 4/1961 | Harrah |
| 3,103,049 | A | * | 9/1963 | Hawley ..... 24/400 |
| 3,153,269 | A | | 10/1964 | Berry |
| 3,203,062 | A | | 8/1965 | Ausnit |
| 3,259,951 | A | | 7/1966 | Zimmerman |
| 3,266,112 | A | | 8/1966 | Heckman |
| 3,309,746 | A | | 3/1967 | Carlile |
| 3,325,084 | A | | 6/1967 | Ausnit |
| 3,338,285 | A | | 8/1967 | Jaster |
| 3,426,396 | A | | 2/1969 | Laguerre |
| 3,490,109 | A | | 1/1970 | Heimberger |
| 3,579,747 | A | | 5/1971 | Hawley |
| 3,591,914 | A | | 7/1971 | Heimberger |
| 3,660,875 | A | | 5/1972 | Gutman |
| 3,914,827 | A | | 10/1975 | Brown et al. |
| 3,959,856 | A | | 6/1976 | Ausnit |
| 4,070,515 | A | | 1/1978 | Smarook |
| 4,112,150 | A | | 9/1978 | Brown et al. |
| 4,137,608 | A | | 2/1979 | Moertel |
| 4,199,845 | A | | 4/1980 | Ausnit |
| 4,262,395 | A | | 4/1981 | Kosky |
| 4,756,061 | A | | 7/1988 | Jones et al. |
| 4,890,935 | A | | 1/1990 | Ausnit et al. |
| 4,905,694 | A | | 3/1990 | Will |
| 4,929,487 | A | | 5/1990 | Tilman et al. |
| 4,941,238 | A | | 7/1990 | Clark |
| 5,007,142 | A | | 4/1991 | Herrington |
| 5,007,143 | A | | 4/1991 | Herrington |
| 5,007,145 | A | | 4/1991 | Kim |
| 5,010,627 | A | | 4/1991 | Herrington et al. |
| 5,062,186 | A | | 11/1991 | Rampolla et al. |
| 5,067,208 | A | | 11/1991 | Herrington, Jr. et al. |
| 5,070,583 | A | | 12/1991 | Herrington |
| 5,119,530 | A | | 6/1992 | Murabayashi et al. |
| 5,152,613 | A | | 10/1992 | Herrington, Jr. |
| 5,161,286 | A | | 11/1992 | Herrington, Jr. et al. |
| 5,253,395 | A | | 10/1993 | Yano |
| 5,283,932 | A | | 2/1994 | Richardson et al. |
| 5,301,395 | A | * | 4/1994 | Richardson et al. ..... 24/400 |
| 5,397,182 | A | | 3/1995 | Gaible et al. |
| 5,415,904 | A | | 5/1995 | Takubo et al. |
| 5,438,744 | A | | 8/1995 | Horikawa et al. |
| 5,553,339 | A | | 9/1996 | Thomas |
| 5,599,415 | A | | 2/1997 | Tomic et al. |
| 5,636,415 | A | | 6/1997 | James |
| 5,664,299 | A | | 9/1997 | Porchia et al. |
| 5,722,128 | A | | 3/1998 | Toney et al. |
| 5,809,621 | A | | 9/1998 | McCree et al. |
| 5,867,875 | A | | 2/1999 | Beck et al. |
| 5,919,535 | A | | 7/1999 | Dobreski et al. |
| 5,991,980 | A | | 11/1999 | Meager |
| 6,033,113 | A | | 3/2000 | Anderson |
| 6,059,457 | A | | 5/2000 | Sprehe et al. |
| 6,185,796 | B1 | | 2/2001 | Ausnit |
| 6,305,844 | B1 | | 10/2001 | Bois |
| 6,363,531 | B1 | | 4/2002 | Quinn |
| 6,385,818 | B1 | | 5/2002 | Savicki, Sr. |
| 6,394,299 | B1 | | 5/2002 | Hupp |
| 6,438,757 | B1 | | 8/2002 | Quinn |
| 6,499,878 | B1 | | 12/2002 | Dobreski et al. |
| 6,510,595 | B2 | | 1/2003 | Matsushima et al. |
| 6,592,800 | B1 | | 7/2003 | Levitt |
| 6,721,999 | B2 | | 4/2004 | Meager |
| 7,062,786 | B2 | | 6/2006 | Stinton |
| 2002/0015539 | A1 | | 2/2002 | Gonella |
| 2004/0049896 | A1 | | 3/2004 | Savicki |
| 2005/0050699 | A1 | | 3/2005 | Yoneoka |
| 2005/0125968 | A1 | | 6/2005 | Yamazaki |
| 2005/0157957 | A1 | | 7/2005 | Turvey et al. |

FOREIGN PATENT DOCUMENTS

| | | |
|---|---|---|
| CH | 287845 | 12/1952 |
| EP | 279599 | 8/1988 |
| EP | 676330 | 10/1995 |
| FR | 1043998 | 11/1953 |
| FR | 2507446 | 12/1982 |
| GB | 899 875 | 6/1962 |
| GB | 2266660 | 11/1993 |
| GB | 2267933 | 12/1993 |
| WO | 95/27418 | 10/1995 |
| WO | 99/09854 | 3/1999 |
| WO | 02/087379 | 11/2002 |
| WO | 03/074371 | 9/2003 |
| WO | 2008/137135 | 11/2008 |

* cited by examiner

FIG. 4
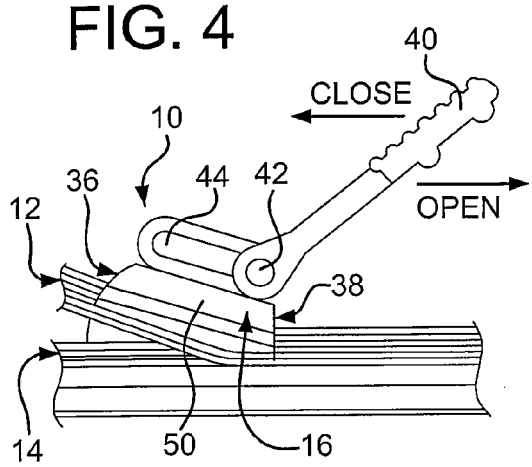
FIG.5
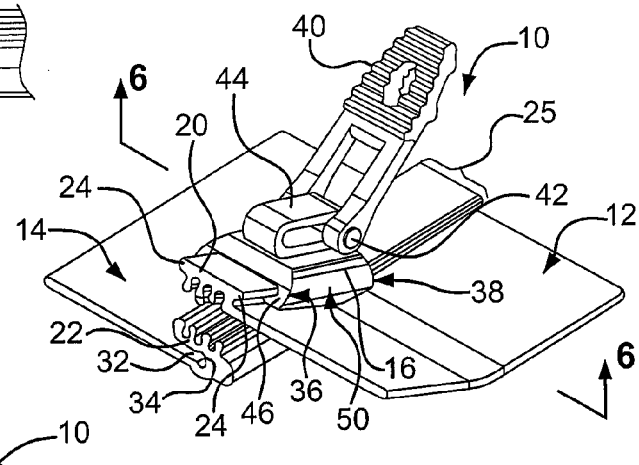
FIG. 6
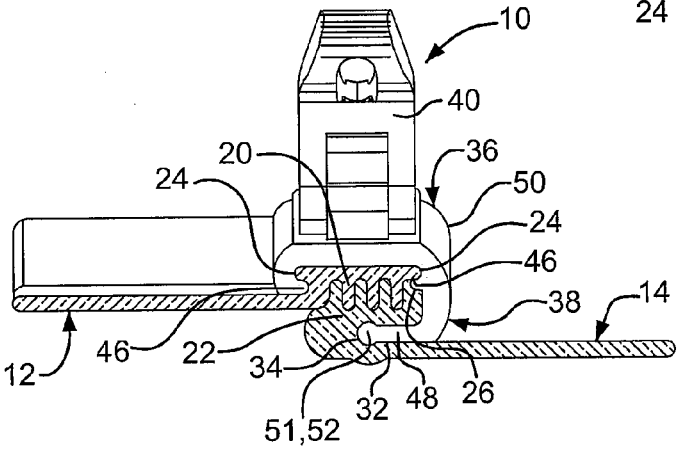
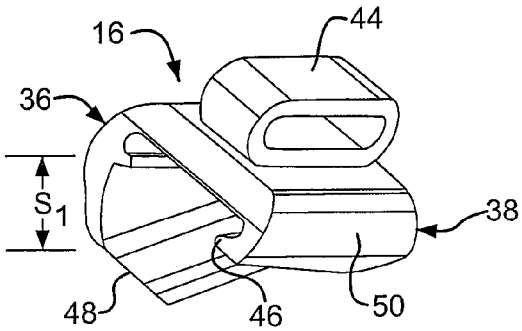
FIG. 7
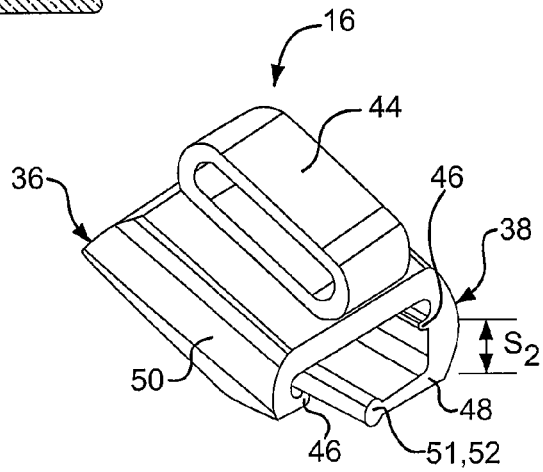
FIG. 8

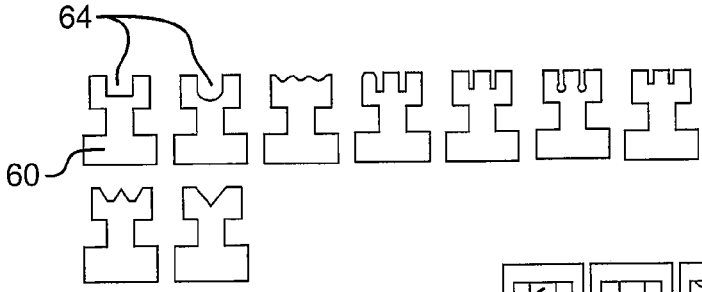
FIG. 13
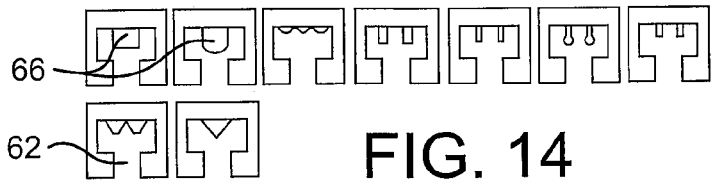
FIG. 14
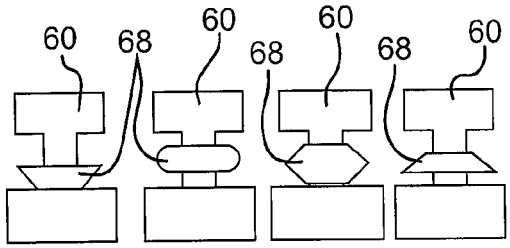
FIG. 15
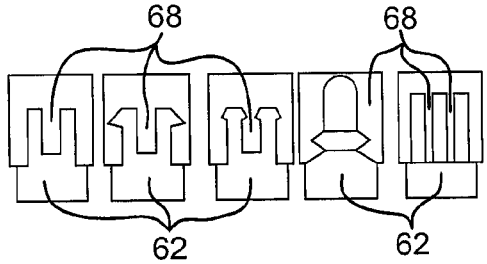
FIG. 16
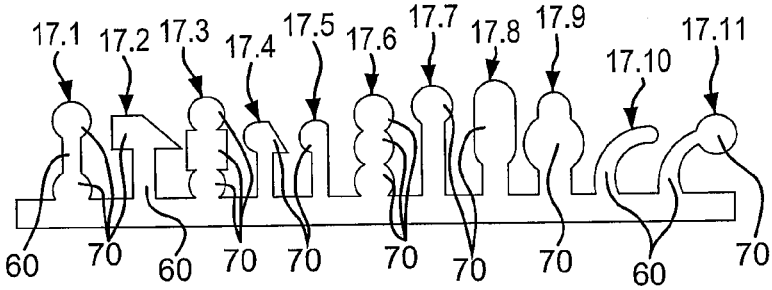
FIG. 17.1-17.11
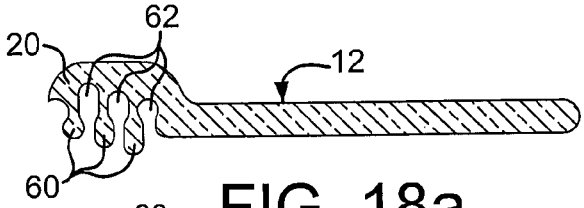
FIG. 18a
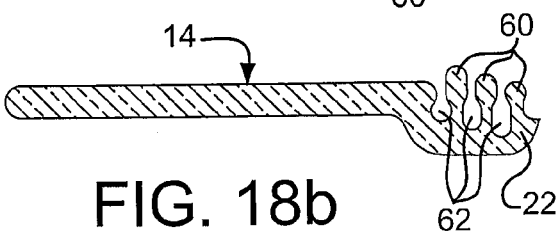
FIG. 18b
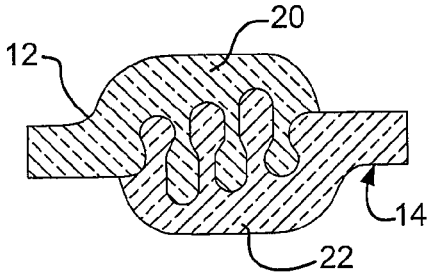
FIG. 18c FIG. 19
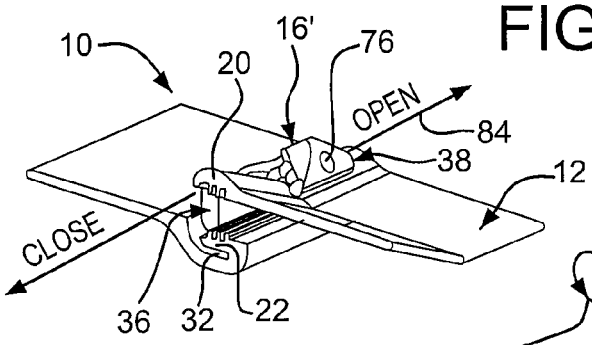
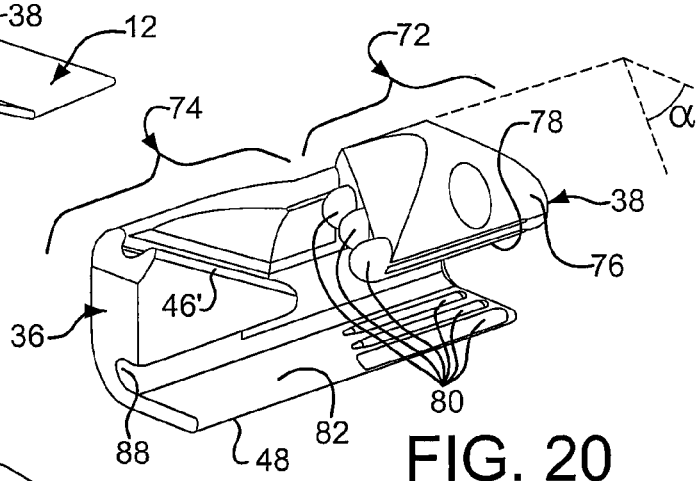
FIG. 20
FIG. 22
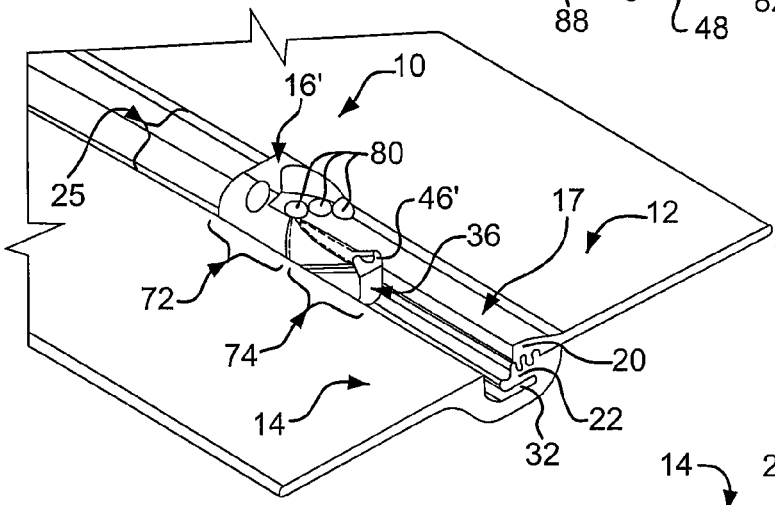
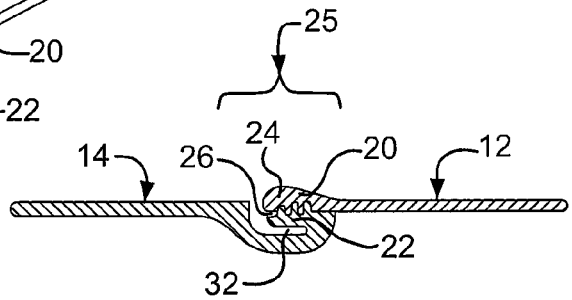
FIG. 21
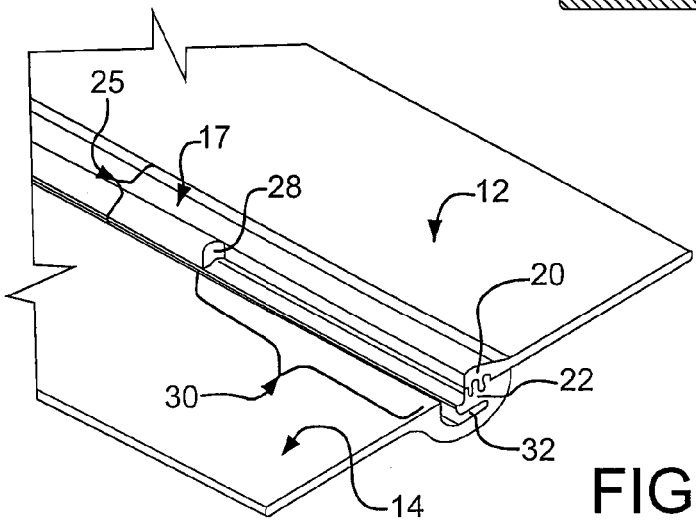
FIG. 23

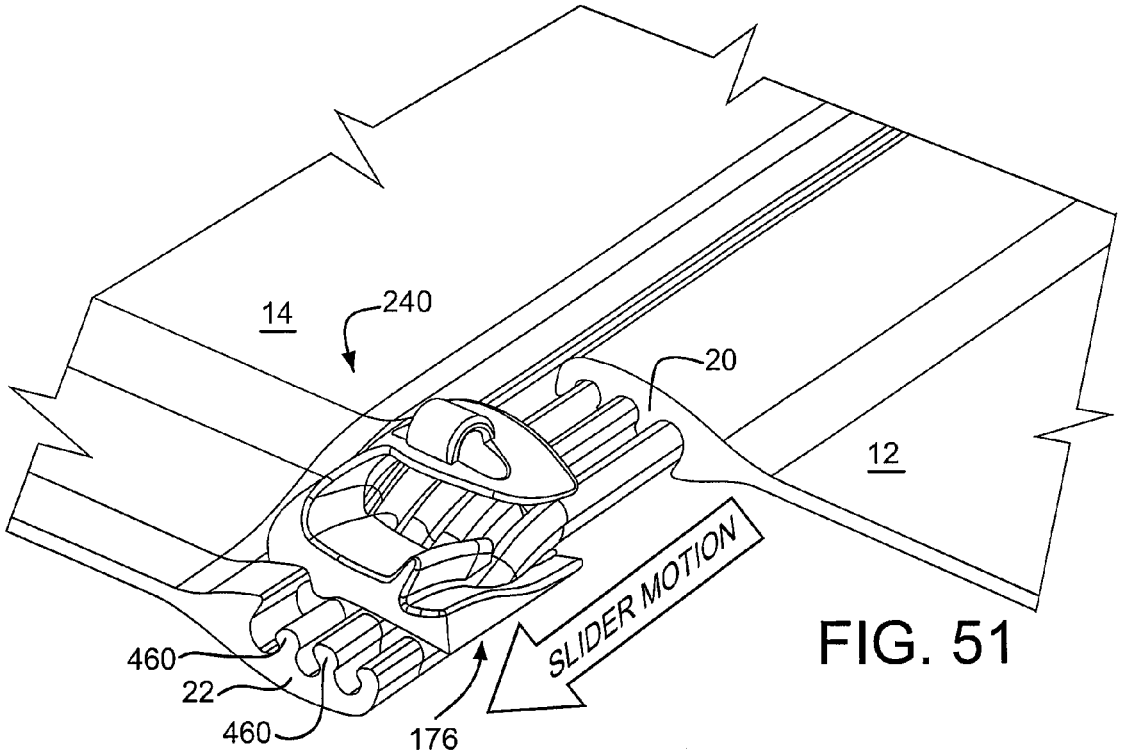
FIG. 51
FIG. 52
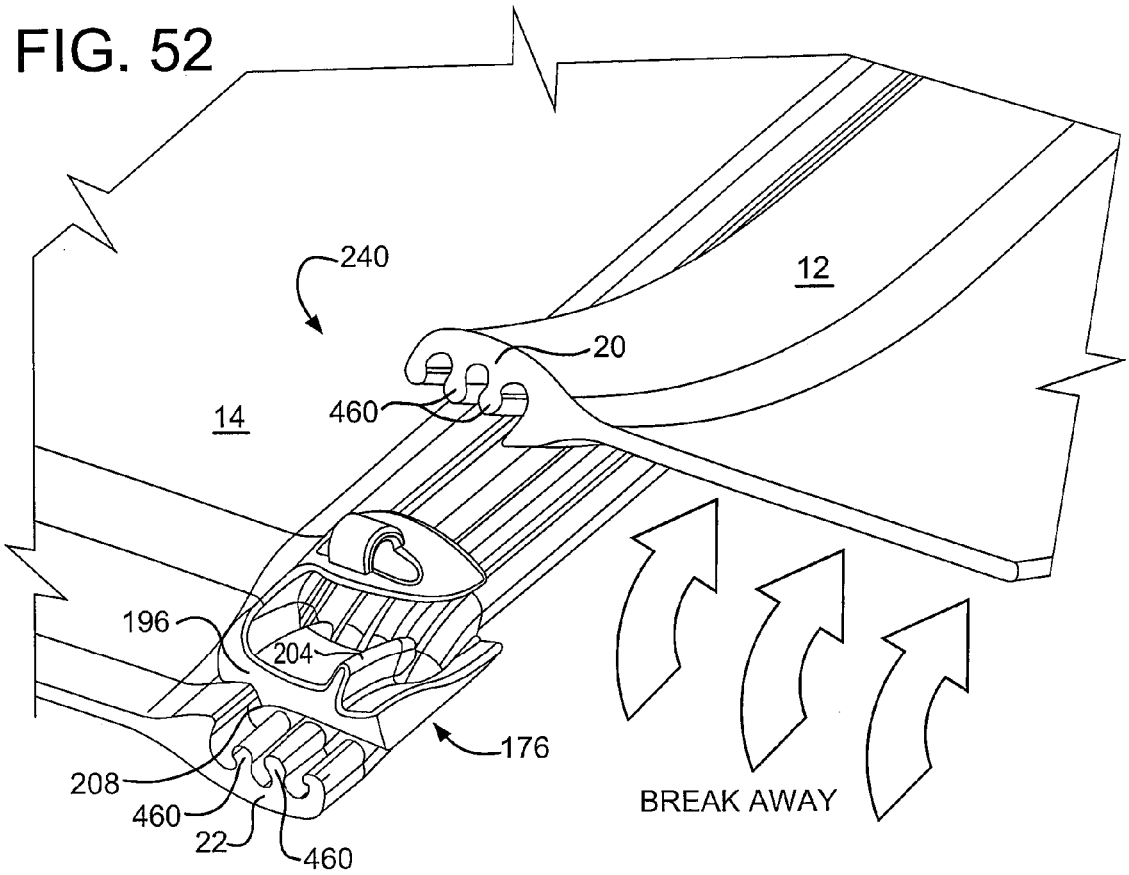

DEVICE FOR CREATING A SEAL BETWEEN FABRICS OR OTHER MATERIALS

CROSS REFERENCE TO RELATED APPLICATIONS

The present application is a continuation of U.S. patent application Ser. No. 11/258,655, filed Oct. 25, 2005 now U.S. Pat. No. 7,451,530, entitled "DEVICE FOR CREATING A SEAL BETWEEN FABRICS OR OTHER MATERIALS," which is a continuation-in-part of U.S. patent application Ser. No. 10/803,834, filed Mar. 17, 2004 now U.S. Pat. No. 7,536,758, entitled "DEVICE FOR CREATING A SEAL BETWEEN FABRICS OR OTHER MATERIALS," which is a continuation application of U.S. patent application Ser. No. 10/135,881 entitled "DEVICE FOR CREATING A SEAL BETWEEN FABRICS OR OTHER MATERIALS" filed on Apr. 29, 2002, now U.S. Pat. No. 6,721,999, issued Apr. 20, 2004, which claimed priority to U.S. Provisional Patent Application Ser. No. 60/287,938 filed on Apr. 30, 2001, and entitled "DEVICE FOR CREATING A WATERTIGHT SEAL BETWEEN FABRICS AND/OR OTHER MATERIALS"; in addition, the current continuation-in-part application also claims the benefit of U.S. Provisional Patent Application No. 60/622,191 filed Oct. 25, 2004 entitled "DEVICE FOR CREATING A SEAL BETWEEN FABRICS OR OTHER MATERIALS." The above-identified patent applications are incorporated herein by reference in their entirety.

FIELD OF THE INVENTION

The present invention relates to a device that is capable of creating a seal between fabrics and other materials.

BACKGROUND OF THE INVENTION

Fastening devices typically include two flexible elongated components having teeth that are forced to interlock and separate by moving a slide along the components. Although such fastening devices have long been used to close and open various articles, such as clothing and bags, such devices suffer from the allowance of liquids and gases within the fastener, and are therefore not useful for conditions in which a windproof, gas-tight and/or waterproof article is desirable.

Fluid-tight fasteners are available, but such fasteners are typically not fluid-tight at the ends of the fastener. Furthermore, other devices have sealing members that are aligned adjacent each other as opposed to extending away from each other. Still other devices are expensive, heavy, and/or require the use of a covering material over the fastener to establish a wind and/or watertight closure.

There is also a need for an endless sealing device for the attachment of a first item to a second item, such as attachment of glove or boot to a hazardous waste protective suit.

There is also a need for a sealing device that provides a substantially low profile slider that operates in conjunction with an upper seal member and a lower seal member that are directed in substantially opposing directions. For example, it would be advantageous to provide a slider that operates with upper and lower sealing members for a jacket, thereby providing a waterproof and windproof closure along the length of the seal, while having a relatively low profile and having the upper and lower seal members also lie substantially flat.

There is also a need for a zipper system that will allow a soldier or emergency response worker to push their way out of a sleeping bag under extreme or emergency conditions. In such conditions, the user of the sleeping bag does not have the time or the ability to redirect their focus on fumbling with tabs or zipper pulls because these devices are too difficult to operate under extremely stressful and/or life threatening conditions. The prior art offers typical sleeping bag configurations with a standard zipper that does not permit the user to rapidly breakaway and exit the sleeping bag in stressful situations or poor weather conditions. Accordingly, a breakaway sleeping bag (or alternate enclosure item) is need that is preferably easy to operate, fast to exit, water-resistant, and cost-effective.

There is also a need for a device to cooperate with a slider and upper and lower seal members, wherein the device can be positioned at the end of the seal for holding the upper seal member in place relative to the lower seal member while advancing the slider along the upper and lower seal members to form the seal.

There is also a need for mating shapes that provide a proper watertight and gas migration resistant seal, while also providing sufficient resistance to unwanted opening of the seal.

SUMMARY OF THE INVENTION

The unique feature of the present invention is its ability to provide a seal to an object that has two opposing surfaces of material, while always maintaining the slider portion of the device to the exterior of the enclosure.

In a first embodiment, the seal device is comprised of three main components (1) a upper seal member, (2) a lower seal member, and (3) a slider. The slider includes at least one lifting rib and a closure bar. In use, the slider is moved back and forth across the length of the seal to interlock the upper seal member to the lower seal member, thereby forming a seal. More particularly, the slider body includes a confining portion that presses the upper seal member into the lower seal member when the slider is moved in a closing direction. To open the seal, the lifting rib within the slider pulls the upper seal member away from the lower seal member that is anchored to the bottom of the slider by the closure bar.

In a modification of the first embodiment, a slider is provided that only contains one lifting rib within an opening portion of the slider. The closure portion of the slider includes a closure bar that anchors the lower seal member, and allows the slider body to press the upper seal member into the lower seal member to close the seal. The closure portion may include a canted portion that tilts, thereby creating some slight rotation of the upper seal member as it enters the lower seal member, thereby improving the seal quality. The opening portion of this modified embodiment preferably includes one lifting rib that separates the upper seal member from the lower seal member by lifting the upper seal member under its lifting wing. Separation from the lower seal member occurs because the lower seal member is anchored to the bottom of the slider by the closure bar that preferably extends the length of the slider. When used with one lifting rib, the opening portion creating some slight rotation of the upper seal member as it exits the lower seal member, thereby improving the ease of slider movement and the longevity of the seal quality.

In a second embodiment, a waterproof sealing device is comprised of four main components (1) an upper seal member, (2) a lower seal member, (3) a slider, and (4) a plug. The upper seal member of this embodiment does not require a lifting wing. Furthermore, the lower seal member does not require a closure bar groove. The slider of this embodiment has interior structure that mates and cooperates with (circumscribes) the seal surfaces of the upper seal member and the lower seal member. Furthermore, the shape of the interior structure of the slider is analogous to a funnel. As the slider is passed along the length of the seal, the slider confines the seal at its closing end to from the seal. That is, the upper seal member and the lower seal member are funneled together. When used in an opening direction, the opposite occurs, and the interior structure of the seal separates the upper seal member from the lower seal member.

Another embodiment of the present invention creates a waterproof seal at the end-most extent of the seal using the plug. The plug is permanently affixed to the end of the seal. Furthermore, the plug contains interior structure that mates with mating surfaces of the upper seal member and the lower seal member. In addition, the structure of the plug mates with the slider when the slider is moved into its closing position with the slider. Therefore, the mating surfaces of the upper seal member and the lower seal member create a seal around the interior structure of both the slider and the plug when the slider is moved into its closing position with the plug.

In accordance with at least one embodiment of the present invention, a sealing device includes a slider having a curved lifting wing. More particularly, a sealing device for forming or creating a seal is provided, the sealing device comprising a slider, and first or an upper seal member having a first mating surface and a lifting wing, a second or lower seal member having a second mating surface and a closure bar groove, wherein the second mating surface interlocks with the first mating surface. The slider comprises a lifting rib slidably cooperating with the lifting wing of the upper seal member, the lifting rib curving radially inward from a first position within the slider to second position at an opening end of the slider. In addition, the slider includes a closure bar slidably cooperating with the closure bar groove of the lower seal member. The slider also includes a body having a closing end wherein the lifting rib is in closing proximity with the closure bar, and wherein the lifting rib is in opening proximity with the closure bar at the opening end. The slider is moveable along the upper seal member and the lower seal member to pass the upper and lower seal members within the slider from the opening end to the closing end, the slider confining the first mating surface into contact with the second mating surface, thereby forming a seal.

In accordance with at least one embodiment of the present invention, at least one of the upper seal member and the lower seal member is comprised of at least two different durometer materials.

In accordance with at least one embodiment of the present invention, at least one of the upper and lower seal members comprises a stiffener insert.

In accordance with at least one embodiment of the present invention, the body of the slider includes a top having an inner surface, the inner surface including a male rib that cooperates with a female groove in a top surface of the upper seal member to assist in maintaining a proper alignment of the slider as the slider is moved along the upper seal member.

In accordance with at least one embodiment of the present invention, the body of the slider comprises partial cylindrical shapes positioned to contact at least one of the upper and lower seal members.

In accordance with at least one embodiment of the present invention, the upper and lower seal members each have start, middle and end portions, wherein the lifting wing on the upper seal member is on the middle portion and not on the start and end portions.

In accordance with at least one embodiment of the present invention, the slider further comprises a pull tab, a pin and a slanted pull tab track, the pull tab slidable within the pull tab track.

In accordance with at least one embodiment of the present invention, each of the upper and lower seal members are attached to adjacent material surfaces, wherein the adjacent material surfaces are substantially parallel.

In accordance with at least one embodiment of the present invention, each of the upper and lower seal members are attached to adjacent material surfaces, wherein the adjacent material surfaces are substantially coplanar adjacent the first and second mating surfaces.

In accordance with at least one embodiment of the present invention, both the first and second mating surfaces comprise at least one hourglass-shaped male shape.

In accordance with at least one embodiment of the present invention, both the first and second mating surfaces comprise at least one combination male shape having a first side that is substantially hourglass-shaped and a second side that is substantially mushroom-shaped.

In accordance with at least one embodiment of the present invention, the upper and lower seal members are continuous and form endless loops, and the seal comprises an endless seal.

In accordance with at least one embodiment of the present invention, the slider comprises a releasably securable or lockable top, and may comprise a hinge.

At least one embodiment of the present invention offers the novel advantage or providing a construct for forming an endless seal. Thus, in accordance with at least one embodiment of the present invention, a device for forming an endless seal comprises: (a) an endless first or upper seal member having a first mating surface; (b) an endless second or lower seal member having a second mating surface, wherein the second mating surface interlocks with the first mating surface; and (c) a slider having a releaseably securable top, the slider for interlocking the first mating surface to the second mating surface. At least a portion of the endless upper seal member can be positioned over at least a portion of the endless lower seal member at the slider when the releasably securable top is in a first open position, wherein the releasably securable top can be placed in a second locked position wherein the slider locks the endless upper seal member to the endless lower seal member, and wherein the slider can be traversed along the endless upper and lower seal members to engage the first and second mating surfaces to form the endless seal.

In accordance with at least one embodiment of the present invention, a cross section of the endless seal is substantially circular in shape.

In accordance with at least one embodiment of the present invention, the endless upper seal member has a lifting wing, the endless lower seal member has a closure bar groove, and the slider includes: (i) a lifting rib slidably cooperating with the lifting wing of the endless upper seal member; (ii) a closure bar slidably cooperating with the closure bar groove of the endless lower seal member; and (iii) a body having a closing end wherein the lifting rib is in closing proximity with the closure bar, and an opening end wherein the lifting rib is in opening proximity with the closure bar. The slider is moveable along the endless upper seal member and the endless lower seal member to pass the upper and lower seal members within the slider from the opening end to the closing end, the slider moveable from a start position along a length of the endless upper and lower seal members to an end position, wherein the end position is located at least one of: (A) the start position; and (B) substantially adjacent to the start position, and wherein the slider confines the first mating surface into contact with the second mating surface thereby forming the endless seal.

In accordance with at least one embodiment of the present invention, the releasably securable top has an inner surface, the inner surface including a male rib that cooperates with a female groove in a top surface of the endless upper seal member to assist in maintaining a proper alignment of the slider as the slider is moved along the endless upper seal member.

In accordance with at least one embodiment of the present invention, the body of the slider comprises partial cylindrical shapes positioned to contact at least one of the endless upper and lower seal members.

In accordance with at least one embodiment of the present invention, the endless upper seal member includes a gap section wherein the lifting wing is not present.

In accordance with at least one embodiment of the present invention, a device for forming an endless seal comprises: (a) an endless upper seal member having a first mating surface; (b) an endless lower seal member having a second mating surface, wherein the second mating surface interlocks with the first mating surface; and (c) a slider moveable along the endless upper and lower seal members for interlocking the first mating surface to the second mating surface, thereby forming the endless seal.

In accordance with at least one embodiment of the present invention, an endless seal or endless closure comprises at least one of (a) a gas migration resistant seal; (b) an air tight seal; (c) a water resistant seal; (d) a water proof seal; (e) a fluid permeable seal; and (f a gas permeable seal.

In accordance with at least one embodiment of the present invention, at least a portion of an endless upper seal member can be positioned over at least a portion of an endless lower seal member at the slider when the releasably securable top is in a first open position, wherein the releasably securable top can be placed in a second locked position wherein the slider locks the endless upper seal member to the endless lower seal member, and wherein the slider can be traversed along the endless upper and lower seal members to engage the first and second mating surfaces to form the endless seal.

In accordance with at least one embodiment of the present invention, the endless upper seal member has a lifting wing, the endless lower seal member has a closure bar groove, and the slider includes: (i) a lifting rib slidably cooperating with the lifting wing of the endless upper seal member; (ii) a closure bar slidably cooperating with the closure bar groove of the endless lower seal member; and (iii) a body having a closing end wherein the lifting rib is in closing proximity with the closure bar, and an opening end wherein the lifting rib is in opening proximity with the closure bar. The slider is moveable along the endless upper seal member and the endless lower seal member to pass the upper and lower seal members within the slider from the opening end to the closing end, the slider moveable from a start position along a length of the endless upper and lower seal members to an end position, wherein the end position is located at least one of: (A) the start position, and (B) substantially adjacent to the start position, and wherein the slider confines the first mating surface into contact with the second mating surface thereby forming the endless seal.

In accordance with at least one embodiment of the present invention, a device for forming an endless closure, comprises: (a) a first endless closure member; (b) a second endless closure member, wherein the second endless closure member interlocks with the first endless closure member; and (c) means for interlocking moveable along the first and second endless closure members for interlocking the first endless closure member to the second endless closure member, thereby forming the endless closure.

In accordance with at least one embodiment of the present invention, the first endless closure member comprises a first mating surface that interlocks with a second mating surface of the second endless closure.

In accordance with at least one embodiment of the present invention, a novel device for forming a seal is provided, wherein the slider does not include a lifting rib and does not include a closure bar. Similarly, the first or upper seal member does not including a lifting wing, and the second or lower seal member does not include a closure bar groove. Thus, in accordance with at least one embodiment of the present invention, a sealing device is provided, comprising: (a) an upper seal member having a first mating surface; (b) a lower seal member having a second mating surface, wherein the second mating surface interlocks with the first mating surface; and (c) a slider for interlocking the first mating surface to the second mating surface, the slider having an intermediate lateral member having only a first side connected to a top of the slider and having only a second side connected to a bottom of the slider. The slider is moveable along the upper seal member and the lower seal member to pass the upper and lower seal members within the slider from an opening end to a closing end of the slider, wherein the slider confines the first mating surface into contact with the second mating surface, thereby forming the seal.

In accordance with at least one embodiment of the present invention, the intermediate lateral member comprises a first substantially upward oriented rib and a second substantially downward oriented rib, the first rib cooperating with the upper seal member as the slider is moved along the upper seal member, and the second rib cooperating with the lower seal member as the slider is moved along the lower seal member.

In accordance with at least one embodiment of the present invention, a beginning stop block is provided at an end of the lower seal member, the beginning stop block including a means for releasably securing the upper seal member.

In accordance with at least one embodiment of the present invention, the closing end of the slider is positioned adjacent the beginning stop block prior to moving the slider to form the seal.

In accordance with at least one embodiment of the present invention, the means for releasably securing comprises a projection to engage a hole in the upper seal member.

In accordance with at least one embodiment of the present invention, the means for releasably securing utilizes at least one of: (i) a friction force for securing the upper seal member to the beginning stop block; and (ii) a magnetic force for securing the upper seal member to the beginning stop block.

In accordance with at least one embodiment of the present invention, the slider disengages at least one of the upper or lower seal members at least one of: (i) an end of the upper or lower seal member; and (ii) a gap in the upper or lower seal member, wherein the gap has a length at least as long as a length of the slider.

In accordance with at least one embodiment of the present invention, a beginning stop block is provided at an end of one of the upper or lower seal members, the beginning stop block including a means for releasably securing at least one of the upper or lower seal member.

In accordance with at least one embodiment of the present invention, the upper seal member may be separated from the lower seal member by application of a breakaway force between the upper and lower seal members, and wherein the slider does not block the separation of the upper seal member from the lower seal member along any portion of a length of the upper seal member.

In accordance with at least one embodiment of the present invention, a product utilizing a breakaway sealing device is a sleeping bag.

In accordance with at least one embodiment of the present invention, the lower sealing member comprises a dual lower sealing member having first and second mating surfaces, wherein the first and second mating surfaces are spaced apart. In accordance with at least one embodiment of the present invention, a second upper sealing member is provided for interlocking with the dual lower sealing member.

In accordance with at least one embodiment of the present invention, a device for forming a seal is provided, the device comprising: (a) an upper seal member having a first mating surface; (b) a lower seal member having a second mating surface, wherein the second mating surface interlocks with the first mating surface; and (c) a slider for interlocking the first mating surface to the second mating surface, the slider having an intermediate lateral member having a front edge, the slider having at least one of: (i) a top having a top front edge located longitudinally behind the front edge of the intermediate lateral member; and (ii) a bottom having a bottom front edge located longitudinally behind a front of the intermediate lateral member. The slider is moveable along the upper seal member and the lower seal member to pass the upper and lower seal members within the slider from an opening end to a closing end of the slider, wherein the slider confines the first mating surface into contact with the second mating surface, thereby forming the seal. In accordance with at least one embodiment of the present invention, only a first side of the intermediate lateral member is connected to the top of the slider and wherein only a second side of the intermediate lateral member is connected to the bottom of the slider. In accordance with at least one embodiment of the present invention, the intermediate lateral member comprises a first substantially upward oriented rib and a second substantially downward oriented rib, the first rib cooperating with the upper seal member as the slider is moved along the upper seal member, and the second rib cooperating with the lower seal member as the slider is moved along the lower seal member.

In accordance with at least one embodiment of the present invention, a breakaway sealing device is provided, comprising: (a) an upper seal member having a first mating surface; (b) a lower seal member having a second mating surface, wherein the second mating surface interlocks with the first mating surface; and (c) a slider for interlocking the first mating surface to the second mating surface. The slider is moveable along the upper seal member and the lower seal member to pass the upper and lower seal members within the slider from an opening end to a closing end of the slider, wherein the slider confines the first mating surface into contact with the second mating surface, thereby forming the seal, wherein the slider disengages at least one of the upper or lower seal members at least one of: (i) an end of the upper or lower seal member; and (ii) a gap in the upper or lower seal member, wherein the gap has a length at least as long as a length of the slider. The slider can be disengaged from the upper or lower seal member, and the upper seal member may be separated from the lower seal member by application of a breakaway force between the upper and lower seal members, and wherein the slider does not block the separation of the upper seal member from the lower seal member along any portion of a length of the upper seal member.

In accordance with at least one embodiment of the present invention, the breakaway force for the breakaway sealing device may be generated by forcing apart material connected to the upper and lower seal members.

In accordance with at least one embodiment of the present invention, sliders used with sealing devices may comprise an intermediate lateral member having a front edge, the slider having at least one of: (i) a top having a top front edge located longitudinally behind the front edge of the intermediate lateral member; and (ii) a bottom having a bottom front edge located longitudinally behind a front of the intermediate lateral member; and in accordance with at least one embodiment of the present invention, sealing members used in accordance with the foregoing slider do not include a closure bar groove or a lifting wing.

Products comprising a sealing device in accordance with at least one embodiment of the present invention can include hazardous material suits, fire suits, dry suits, dry bags, bivy sacks, waders, space suits, tents, shipping packages, household storage bags, map cases, chart cases, kayak skirts, backpack covers, computer cases, electronic device cases, watercraft containers, inflatable cases, flotation bags, flotation devices, waterproof pockets, fishing vest pockets, smellproof pockets, wetsuits, jackets, sleeping bags, rain gear, boots, kayak jackets, wind breakers, and wind proof fleeces.

Various embodiments of the present invention are set forth in the attached figures and in the detailed description of the invention as provided herein and as embodied by the claims. It should be understood, however, that this Summary of the Invention may not contain all of the aspects and embodiments of the present invention, is not meant to be limiting or restrictive in any manner, and that the invention as disclosed herein and will be understood by those of ordinary skill in the art to encompass obvious improvements and modifications thereto.

Additional advantages of the present invention will become readily apparent from the following discussion, particularly when taken together with the accompanying drawings.

BRIEF DESCRIPTION OF THE DRAWINGS

Several figures have been developed to assist with understanding the invention.

Following is a brief description of the figures that illustrate the invention and its various embodiments:

FIG. 4 provides a side elevation view of a preferred embodiment of the present invention showing the slider component within the upper and lower seal members;

FIG. 5 provides a perspective view of the configuration shown in FIG. 4;

FIG. 6 provides an elevation view of the closing end of the slider taken along line 6-6 of FIG. 5;

FIG. 7 provides a perspective view of a preferred embodiment the slider component looking at the opening end;

FIG. 8 provides a perspective view of a preferred embodiment the slider component looking at the closing end;

FIG. 13 is a cross-sectional view showing a variety of notch patterns available for male mating surface members;

FIG. 14 is a cross-sectional view showing a female mating surface members corresponding to those depicted in FIG. 13;

FIG. 15 is a cross-sectional view showing several additional shape patterns that may be added to male mating surface members;

FIG. 16 is a cross-sectional view showing several additional shape patterns that may be added to female mating surface members;

FIG. 17.1-17.11 are cross-sectional views of several simple shape patterns that may be added to make mating surface members;

FIG. 18*a* is an upper seal that may be interlocked with a lower seal member of the exact same shape;

FIG. 18*b* is a lower seal member that may be interlocked with the seal member depicted in FIG. 18*a;*

FIG. 18*c* is the seal formed using seal members depicted in FIGS. 18*a* and 18*b;*

FIG. 19 is a perspective view of a modified sealing device of the first embodiment;

FIG. 20 is a perspective view of the modified slider shown in FIG. 19;

FIG. 21 is a cross-sectional view of one possible seal profile that may be used in conjunction with the slider shown in FIG. 20;

FIG. 22 is a perspective view of the modified sealing device of FIG. 19 where the slider is in the vicinity of the end of the seal profiles;

FIG. 23 is a perspective view of the end of the seal profiles showing the cut lifting wing;

FIG. 51 is a perspective view of the device shown in FIG. 50 with the slider moved to a disengaged position;

FIG. 52 is a perspective view of the device shown in FIG. 51 with a breakaway force applied to separate the upper seal member from the lower seal member;

While the following disclosure describes the invention in connection with those embodiments presented, one should understand that the invention is not strictly limited to these embodiments. Furthermore, one should understand that the drawings are not necessarily to scale, and that in certain instances, the disclosure may not include details that are not necessary for an understanding of the present invention, such as conventional details of fabrication and assembly.

DETAILED DESCRIPTION OF THE INVENTION

One embodiment of the present invention is a device for creating a seal. The device includes an upper seal member, a lower seal member and a slider. The upper seal member has a first mating surface and a lifting wing. The lower seal member has a second mating surface and a closure bar groove. The first and second mating surfaces interlock to form a seal. The slider includes a lifting rib that slidably cooperates with the lifting wing of the upper seal member, and a closure bar that slidably cooperates with the closure bar groove of the lower seal member. The slider also includes a body having a closing end at which the lifting rib is in closing proximity with the closure bar and an opening end wherein the lifting rib is in opening proximity with the closure bar. When the slider is moved in a direction causing the upper seal member and the lower seal member to pass within the slider from the opening end to the closing end, the slider confines the first mating surface into contact with the second mating surface thereby creating a seal.

Figure 1:
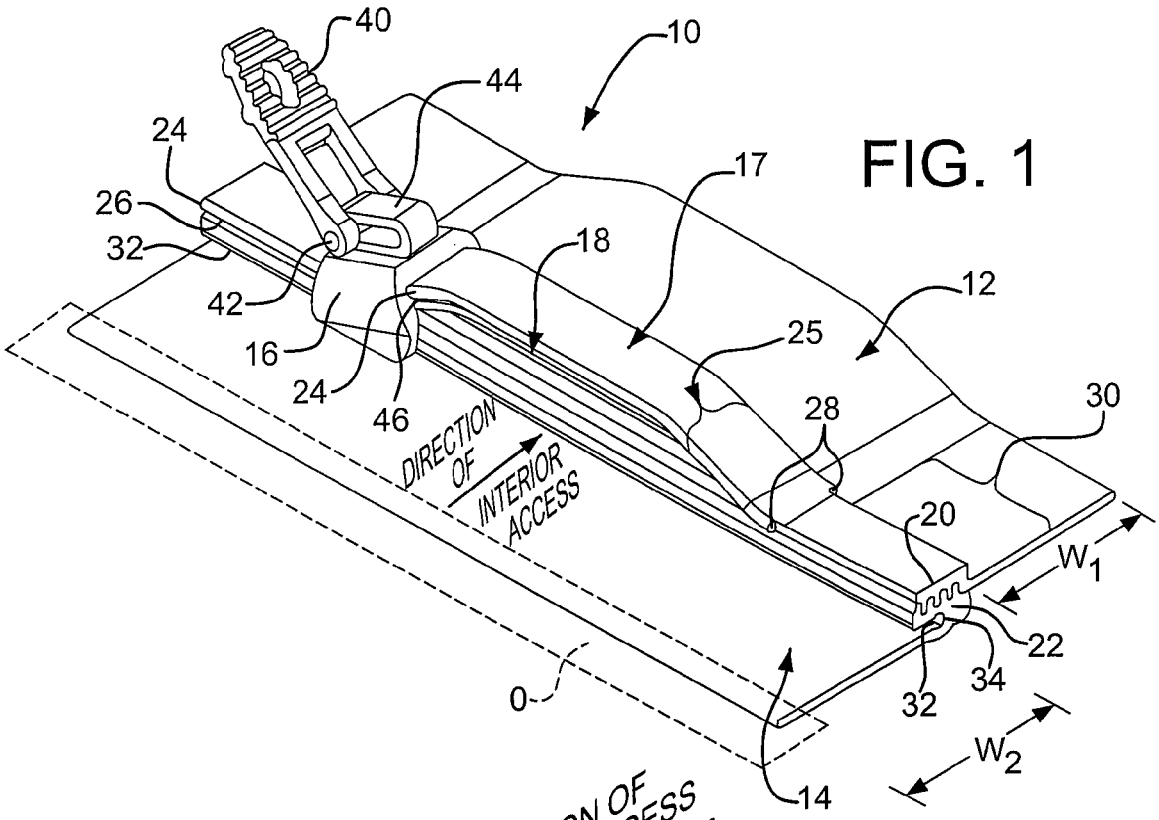
FIG. 1 provides a perspective view of a first embodiment of the waterproof sealing device of the present invention.

Referring initially to FIG. 1, a perspective view of the sealing device 10 is shown. The sealing device 10 includes an upper seal member 12, a lower seal member 14, and a slider 16. Sealing device 10 creates a seal 17 along the entire length of upper seal member 12 and lower seal member 14. When device 10 is unsealed, an opening 18 exists between upper seal member 12 and lower seal member 14, thereby providing access to the space to the interior of the seal 17.

In use, a seal 17 is formed by sliding slider 16 down the length of seal 17, which causes the slider 16 to interlock the mating surface 20 of upper seal member 12 with the mating surface 22 of lower seal member 14. As such, the present invention bears similarity to a zipper, whereby the user of the device zips the device 10 closed to form a seal, and unzips device 10 to gain access to the interior of the seal 17.

Figure 2:
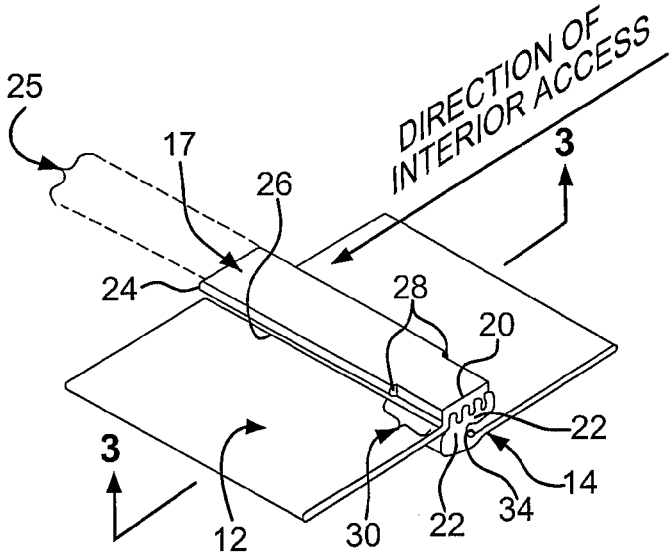
FIG. 2 provides a perspective view of a first embodiment of the upper sealing member and the lower sealing member portions of the present invention.

Referring now to FIG. 2, a perspective view of upper seal member 12 and lower seal member 14 is shown without the slider 16 present. FIG. 2 clearly illustrates that, if desired, upper seal member 12 may be reversed relative to lower seal member 14. That is, FIG. 1 illustrates that upper seal member 12 extends to the upper right of the page, while the lower seal member 14 extends to the lower left of the page. Conversely, FIG. 2 illustrates that upper seal member 12 may extend in a reverse direction, that is, to the lower right of the page, while the lower seal member 14 extends to the upper right of the page. Therefore, sealing device 10 can be configured to provide access from either direction to the interior of the article to which it is attached. Of course, if seal 17 is sufficiently long, when unsealed upper seal member 12 may be moved away from lower seal member 14 to provide extensive access from any direction to the interior of the article to which device 10 is attached.

Figure 3:
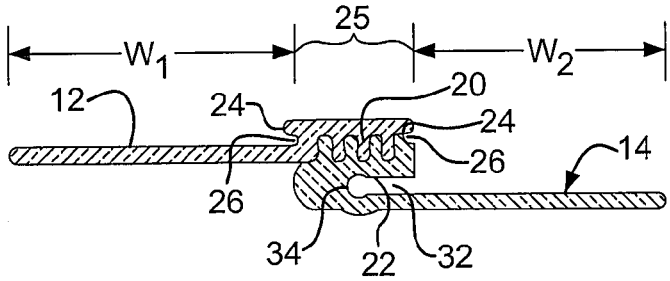
FIG. 3 provides a cross-sectional view of the upper and lower sealing members taken along line 3-3 of FIG. 2.

Referring now to FIG. 3, a cross-sectional view of interlocked upper seal member 12 and lower seal member 14 is depicted. This figure provides a detail view of the structure of the two interlocking members. The upper seal member 12 preferably includes at least one lifting wing 24, and may include two or more lifting wings 24 as depicted in FIG. 3. More specifically, in a preferred embodiment, a portion of upper seal member 12 includes a lifting wing 24 that juts out from the main profile portion 25 of the upper seal member 12. Lifting wing 24 thus creates a lifting wing groove 26 directly thereunder that serves as a receiving location for a lifting rib 46 of slider 16, discussed in detail below. Lifting wing 24 may be a variety of shapes, as may lifting groove 26. If the lifting wing 24 is removed, as depicted starting at location 28 in FIGS. 1 and 2, the absence of the lifting wings 24 prevents the lifting rib 46 of slider 16 from placing a separation force on the upper seal member 12, and thereby prevents slider 16 from separating seal 17 at the beginning of location 28 of the seal 17. Accordingly, an end portion 30 of seal 17 preferably contains a section that is slightly shorter than the length of the slider 16, whereby the lifting wings 24 are absent from the upper seal member 12. In use, when slider 16 is pulled along to the end portion 30 of the seal 17, the lifting rib 46 of the slider 16 disengages from the lifting wing groove 26, thus preventing separation at the front end of the slider 16. This disengagement allows the seal at the front of the slider 16 to remain sealed, thereby providing a seal along the entire length of seal 17, including the end portion 30 where slider 16 is positioned for closure of seal 17.

Still referring to FIG. 3, a closure bar groove 32 is provided for stabilizing lower seal member 14 during operation of the slider 16. In a preferred embodiment, lower seal member 14 includes a closure bar groove 32. Closure bar groove 32 is design to receivingly accept a closure bar 48 of slider 16, shown, e.g., in FIG. 6. Closure bar groove 32 may be of different lengths and shapes, as will be discussed below. Furthermore, closure bar groove 32 may include an end shape 34 that corresponds to an end shape 51 of the terminus 52 of the closure bar 48, as discussed below.

Referring now to FIGS. 1-3, mating surface 20 of upper sealing member 12 and mating surface 22 of lower sealing member 14 provide the structure for creating a functioning seal 17. More particularly, upper seal member 12 includes a mating surface 20 that has a shape that mates with mating surface 22 of lower seal member 14, thereby creating a seal 17. The shape of the mating surfaces 20 and 22 may vary, as discussed below. In use, mating surface 20 is forced into interlocking position with opposing mating surface 22, thus creating seal 17.

Referring to FIGS. 1 and 3, it is an aspect of the present invention to utilize materials of sufficient dimension and material type such that seal 17 may be incorporated into a variety of different objects, such as wet suits, waders, rain gear, marine apparel, and boots, to name but a few. Accordingly, upper seal member 12 preferably includes a sufficient width W.sub.1 of runout material such that it may be permanently attached to an object to form one side of the seal on the object. Similarly, the lower seal member 14 also includes a sufficient width W.sub.2 of runout material such that it too may be permanently attached to an object to form a second side of the seal for the object. Upper seal member 12 and lower seal member 14 are made of resilient material that is capable of interlocking to form a seal. The upper and lower seal members 12, 14 can be made of the same or different resilient materials. Such materials may include, but are not limited to rubber or plastic, such as poly-vinyl chloride (PVC) or linear low density polyethylene (LLDPE). Depending upon the material used, the upper seal member 12 and lower seal member 14 may be glued, heat welded, or otherwise bonded to adjacent material of the enclosure object O, as shown in phantom lines in FIG. 1. Alternatively, the seal 17 of the present invention may be formed as an integral part of the object during manufacture of the object itself. In one aspect of the invention, the upper and lower seal members are attached to adjacent material surfaces as part of a product, such as, for example, a jacket front. Thus, the material surfaces would be the left and right front sides of the jacket, which substantially define a first plane. The interlocked first and second mating surfaces of the upper and lower seal members also substantially define a plane, such as is illustrated in FIG. 6. In this aspect of the invention, these two planes are substantially parallel.

It is an aspect of the present invention that a variety of materials may be used to construct a single device 10. The slider 16 is preferably made of a relatively hard material, such as, without limitation, a hard plastic, rubber, ceramic, metal, metal alloy, or a combination thereof. Mating surfaces 20 and 22 may, if desired, incorporate a multitude of materials. For example, individual male shapes 60 and female shapes 62 may be formed of one material, such as soft rubber, while the remaining portions of the upper seal member 12 and lower seal member 14 may be manufactured of a somewhat harder material that still behaves in a resilient manner. Furthermore, upper seal member 12 and lower seal member 14, including mating surfaces 20 and 22 may incorporate metallic or hard plastic inserts, while hook and loop materials such as velcro may be incorporated into the device 10 as well. In addition, a variety of other materials, such as, without limitation, gel, silicone, polytetrafluoroethylene (PTFE) fibers, metal or coil zipper sections, lubricants, and/or sealants may all be used in or on one or more of the components of the inventions disclosed herein.

The device for creating a seal of the present invention has a wide variety of uses and advantages. In general, the device can be used for outdoor clothing and apparel, outdoor equipment and cases, marine apparel and equipment, and even for everyday apparel. The device is particularly useful for products that are required to be fully watertight. Such products include, without limitation, hazardous material suits, fire suits, dry suits, dry bags, bivy sacks, waders, space suits, tents, shipping packages, household storage bags, map cases, chart cases, kayak skirts, backpack covers, computer cases, electronic device cases, watercraft containers, inflatable cases (for cameras, etc.), flotation bags, flotation devices, waterproof pockets, fishing vest pockets, smell-proof pockets (for bears, etc.), and wetsuits. The device of the present invention is also particularly useful for products requiring or benefitting from being wind proof. Such products include, without limitation, jackets, sleeping bags, rain gear, boots, kayak jackets, wind breakers, wind proof fleeces, and tents. In addition to the advantages of being waterproof and wind proof, the device of the present invention has a number of other advantages, including, without limitation, being: airtight, watertight, gas tight, wind proof, quiet, less likely to get caught or jammed, lightweight, nonmetal (i.e., light, cheap and not cold), fully recyclable, smooth to operate, inexpensive and easy to produce. This device also eliminates the need for zipper-covering flaps and can be used in essentially any zipper function, thereby allowing hundreds of new products to be made using the device. Specifically, such new products can include the following: zip-down waders, zip-down dry bags, zip-down bivy sacks, easy access kayak skirts, fully waterproof rope bags, fully waterproof pockets, watertight/airtight shipping packages, easy access dry suits, everyday camera bags for underwater photos or films, fully waterproof and fully functional backpacks or fanny packs, zip-down rain pants and zip-in-half rain tarps.

Referring now to FIG. 4, a side elevation view of a slider 16 is depicted engaged in upper seal member 12 and lower seal member 14. The slider 16 includes an opening end 36 and a closing end 38. When pulled in either direction along the seal profile 17, the last end of the slider 16 to pass the profile renders the seal either opened or closed. More specifically, opening end 36 serves to separate the upper seal member 12 from the lower seal member 14. Therefore, as slider 16 is pulled along the seal 17, it will open the seal 17 if pulled such that closing end 38 leads opening end 36. Conversely, closing end 38 of slider 16 confines and presses the upper seal member 12 into interlocking union with lower seal member 14. Therefore, as slider 16 is pulled along the seal 17, it will close the seal 17 if pulled such that opening end 36 leads closing end 38. In this mechanism of opening and closing, the seal is opened by force being applied by the lifting rib to the lifting wing to pull the upper seal member from the lower seal member. This mechanism is different from sealing devices where a force is applied directly to a mating or contacting surface that makes a seal.

Still referring to FIG. 4, a pull tab 40 is preferably mounted along the top of slider 16 using a pin 42 to interconnect pull tab 40 within a pull tab sliding track 44. Pull tab 40 slides back and forth in the pull tab sliding track 44 allowing for a more effective pulling angle for the slider 16, thus allowing for a smoother and easier effort to manipulate slider 16.

Referring now to FIG. 5, a lifting rib 46 can be seen at the opening end 36 of slider 16. Lifting rib 46 provides a structure for applying a separating force to the upper seal member 12 relative to the lower seal member 14.

Referring now to FIG. 6, an elevation view of the closing end 38 of the slider 16 taken along line 6-6 of FIG. 5 is provided. FIG. 6 depicts the disposition of the upper seal member 12 and lower seal member 14 at the closing end 38 of slider 16. At the closing end 38, closure bar 48 fits within closure bar groove 32 of lower seal member 14, and serves to confine the mating surface 22 of lower seal member 14 within the body 50 of slider 16. The body 50 of slider 16 is confined at the closing end 38 of slider 16 such that the mating surface 20 of upper seal member 12 is forced to interlock with mating surface 22 of lower seal member 14.

FIG. 7 provides a perspective view of slider 16 looking at the opening end 36 of the slider 16. In contrast, FIG. 8 provides a perspective view of slider 16 looking at the closing end 38 of the slider 16. Lifting ribs 46 located on both lateral sides of slider 16 are shown. It should be noted that lifting ribs 46 can extend along the entire lateral side of slider 16 or along only a portion thereof, such as along the front half of the slider 16 at the opening end 36. The distance between the lifting ribs 46 and the closure bar 48 at the opening end 36 is significantly greater than at the closing end 38 of slider 16. More specifically, separation distance S.sub.1 depicted in FIG. 7 is greater than separation distance S.sub.2 depicted in FIG. 8. Separation distance S.sub.1 is sufficiently large to separate the mating surface 20 of upper seal member 12 from the mating surface 22 of lower seal member 14.

Referring back to FIG. 5, the separation of upper seal member 12 from lower seal member 14 is clearly illustrated at the opening end 36 of slider 16. In contrast, referring back to FIG. 6, the geometry of the closing end 38 of slider 16 is such that upper seal member 12 is in interlocking position with the lower seal member 14. Thus, the distance between the opening end 36 and closing end 38 of slider 16 is a transition zone, whereby upper seal member 12 is releasably separated from lower seal member 14 at opening end 36, or where upper seal member 12 is releasably interlocked with lower seal member 14 at closing end 38.

Figure 9A:
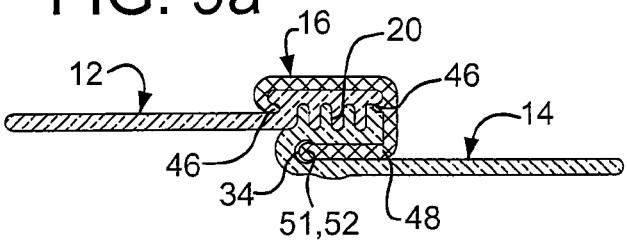
FIG. 9*a* is a cross-sectional view of a seal profile in which the slider has a long closure bar.
Figure 9B:
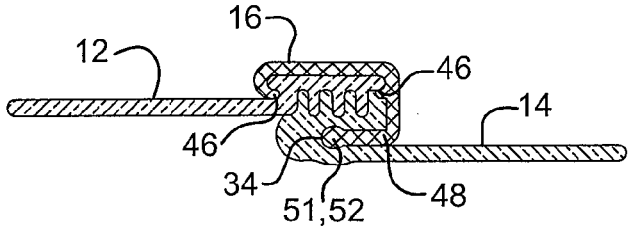
FIG. 9*b* is a cross-sectional view of a seal profile in which the slider has a moderate length closure bar.
Figure 9C:
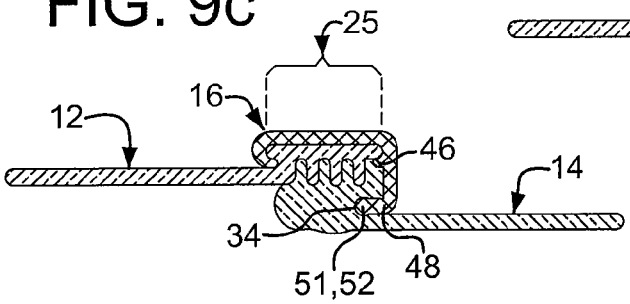
FIG. 9*c* is a cross-sectional view of a seal profile in which the slider has a short closure bar.
Figure 9D:
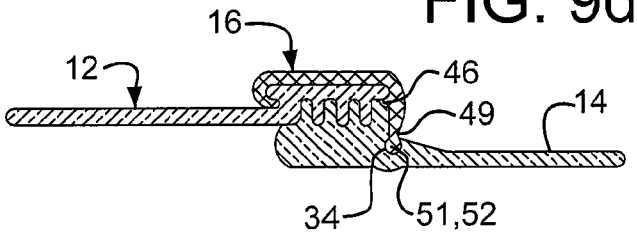
FIG. 9*d* is a cross-sectional view of a seal profile in which the slider has a prong-shaped closure bar.

The component parts of the present invention may incorporate a myriad of different configurations. Referring now to FIGS. 9*a*-9*o*, cross-sectional views of the upper seal member 12 and lower seal member 14 at the closing end 38 of slider 16 are depicted. FIG. 9*a* illustrates that the closure bar 48 may be rather long relative to the width of the seal profile. FIG. 9*b* depicts yet a different modification where the closure bar 48 is of moderate length. With reference to FIG. 9*c*, a relatively short closure bar 48 is depicted, and in FIG. 9*d*, the closure bar 48 is essentially prong-shaped, but still extends into lower seal member 14, although it has negligible lateral length. In the configurations depicted in FIGS. 9*a*-9*d*, the closure bar groove 32 located in lower seal member 14 is manufactured to receive the corresponding sized closure bar 48.

Figure 9E:
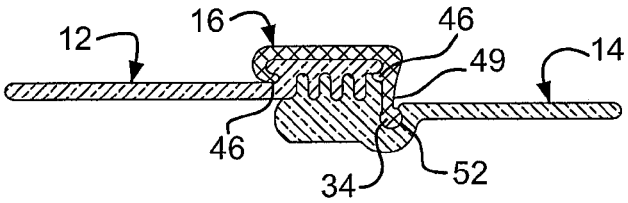
FIG. 9*e* is a cross-sectional view of a seal profile in which the slider has a prong-shaped closure bar with seal members at the same elevation.

Referring now to FIG. 9*e*, lower seal member 14 may be configured to different elevations relative to upper seal member 12. FIG. 9*e* shows that lower seal member 14 may be wrapped around the closure bar 48, such that it rises to the same elevation as the corresponding surface of upper seal member 12. This modification allows for a relatively low profile zipper-like configuration in the vicinity of the seal 17.

Figure 9F:
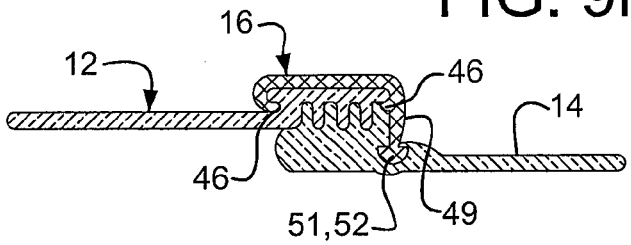
FIG. 9*f* is a cross-sectional view of a seal profile in which the slider has a prong-shaped closure bar having an alternate end shape.
Figure 9G:
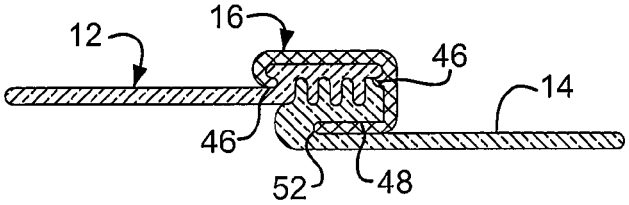
FIG. 9*g* is a cross-sectional view of a seal profile in which the slider has a moderate length closure bar with no end shape.

Referring now to FIG. 9*f*, a variety of end shapes 51 may be used at the terminus 52 of the closure bar 48. Alternately, a simple shape may be used at any point (not shown) along the length of closure bar 48. FIG. 9*f* illustrates that a truncated half circle resembling an arrow may be used as the end shape 51 at terminus 52 of the closure bar 48. Accordingly, although not illustrated, it is to be understood that the terminus 52 may have an end shape 51 taking many forms, including, but not limited to circles, triangles, rectangles, arrow heads, barbs, and polyhedral shapes. Furthermore, as shown in FIG. 9*g*, the terminus 52 of closure bar 48 may be without any type of additional shape at all. This modification is particularly applicable in the case where the closure bar 48 is longer than a simple prong shape, thus providing confinement capability and support to the mating areas of the profile simply by virtue of its length under the mating area itself.

Figure 9H:
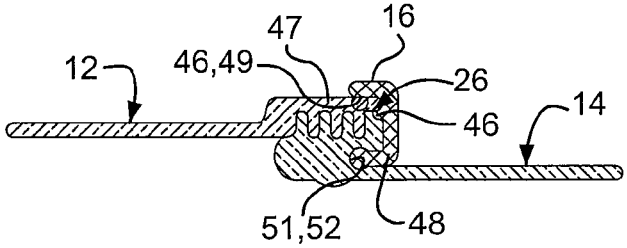
FIG. 9*h* is a cross-sectional view of a seal profile in which the slider has top and side mounted lifting rib.

FIG. 9*h* depicts a modified slider 16 shape that does not wrap around the top surface of the upper seal member 12. Here, the modified slider 16 of FIG. 9*h* has a lifting rib 46 that projects into the top surface 47 of the mating profile of the upper seal member 12. In addition, a second lifting rib 46 in located along the side of slider 16. Advantageously, the topmost lifting rib 46 of this modified slider 16 includes a shape 49 to anchor the lifting rib 46 within the lifting rib groove 26. A variety of shapes 49 for the lifting rib 46 and corresponding lifting rib groove 26 may be used to provide a mechanism for anchoring the lifting rib 46 within the top surface 47 upper seal member 12, such that lifting rib 46 pulls the upper seal member 12 out of the lower seal member 14 at the opening end 36 of slider 16.

Figure 9I:
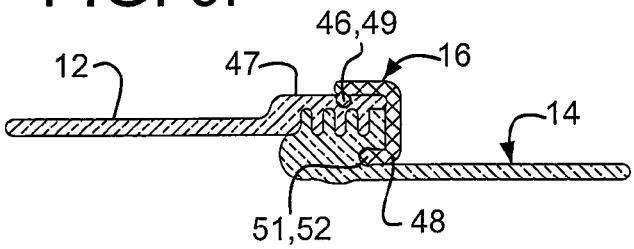
FIG. 9*i* is a cross-sectional view of a seal profile in which the slider has top mounted lifting rib.

Referring now to FIG. 9*i*, a slider 16 having a single lifting rib 46 is provided. More specifically, the modified slider 16 as presented in FIG. 9*i* utilizes a single lifting rib 46 that projects into the top surface 47 of the mating profile 20 of upper seal member 12. As with the slider illustrated in FIG. 9*h*, the slider 16 of FIG. 9*i* uses a shape 49 at the end of the single lifting rib 46 to provide a structure for pulling the upper seal member 12 out of the lower seal member 14 when the profile passes through the opening end 36 of slider 16.

Figure 9J:
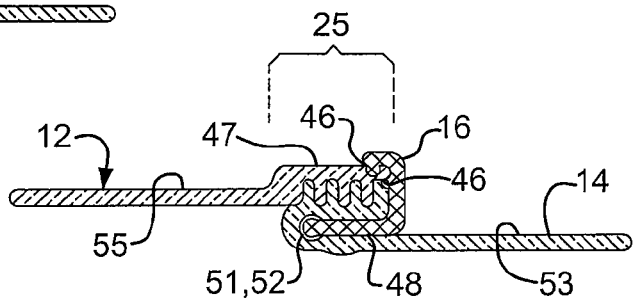
FIG. 9*j* is a cross-sectional view of a seal profile in which the slider has top mounted lifting rib with seal members at the same elevation.

FIG. 9*j* illustrates that a combination of the above-described features may be utilized to form a slider/seal combination. Here, FIG. 9*j* illustrates a slider 16 having a relatively long closure bar 48, and also having two lifting ribs 46, the first lifting rib 46 located on the side of the slider 16, and the second lifting rib 46 is located along the top surface 47 of the main profile portion 25 of the upper seal member 12. Furthermore, lower seal member 14 is wrapped around the side of slider 16 and rises to an elevation such that the top lateral surface 53 of lower seal member 14 is at about the same elevation as the top lateral surface 55 of upper seal member 12.

Figure 9K:
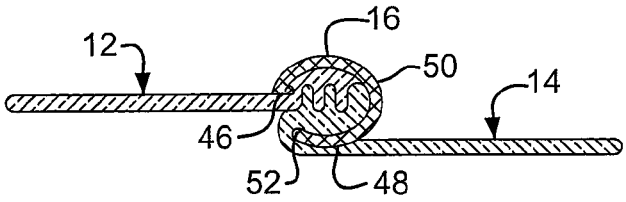
FIG. 9*k* is a cross-sectional view of a seal profile in which the slider is cylindrically shaped.

Referring now to FIG. 9*k*, a slider 16 having a cylindrical shape is shown. The cylindrical shaped slider 16 includes a closure bar 48 and a body 50 that wraps around the exterior of the main profile portion 25 of upper seal member 12, where it terminates at a lifting rib 46. Accordingly, the shape of the slider 16 may vary considerably and yet provide the function of opening and closing seal 17.

Figure 9L:
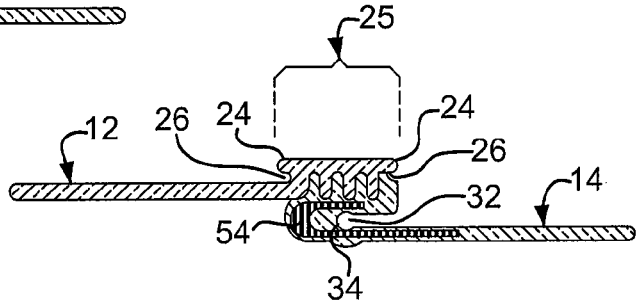
FIG. 9*l* is a cross-sectional view of a seal profile having a hook-shaped stiffener insert.

Referring now to FIG. 9*l*, a stiffener insert 54 is provided for strengthening the profile system of the present invention. More specifically, a plurality of stiffener inserts 54 may be spaced along portions of the seal 17 of the present invention, by including inserts 54 within lower seal member 14. The inserts 54 provide a stronger seal structure, while at the same time permitting the seal to behave in a relatively flexible manner as a result of the spaced nature of placement. Spaced placement of inserts is disclosed in U.S. Pat. No. 5,991,980, the contents of which are incorporated herein by reference, in its entirety.

Figure 9M:
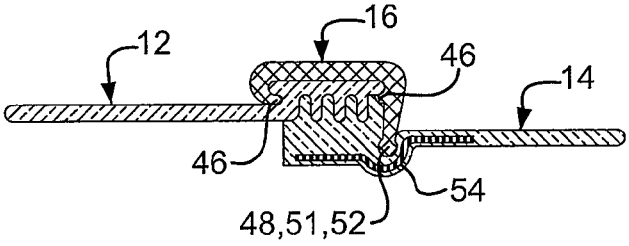
FIG. 9*m* is a cross-sectional view of a seal profile having a curved stiffener insert modified for placement in seal members that are at the same elevation.
Figure 9N:
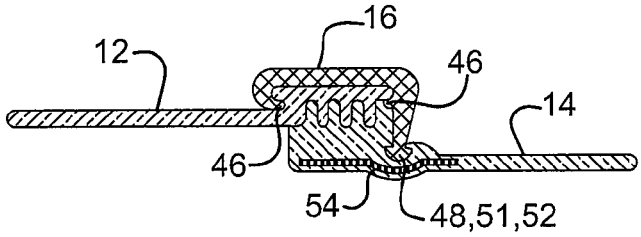
FIG. 9*n* is a cross-sectional view of a seal profile having a stiffener insert that is nearly flat.
Figure 9O:
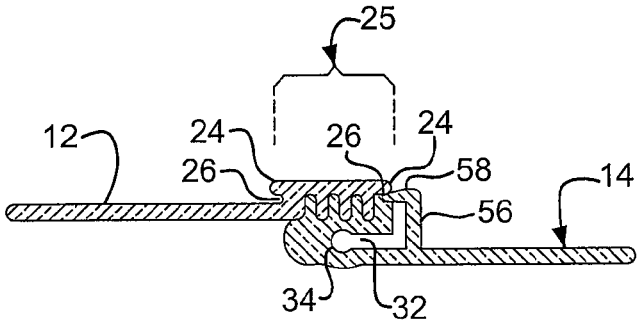
FIG. 9*o* is a cross-sectional view of a seal profile having a stabilizing rib attached to the lower seal member.

Referring again to FIG. 9*l*, the insert 54 is shown bending to follow the general shape of lower seal member 14, where lower seal member 14 includes a closure bar groove 32. Stiffener inserts 54 may be used in any profile shapes disclosed herein. For example, FIG. 9*m* illustrates a slider 16 having a closure bar 48 that is essentially prong shaped. Here, insert 54 follows the general contour of the lower seal member 14, which rises in elevation to match the elevation of the upper seal member 12. Similarly, FIG. 9*n* illustrates the use of an insert 54 with slider 16 that has a semi-circle end shape 51 at the terminus 52 of the closure bar 48.

Referring now to FIG. 9*o*, in a separate aspect of the present invention, a seal member rib 56 may be used to provide additional stability to the seal profile. More particularly, seal member rib 56 is a structure that protrudes from lower seal member 14 to buttress the interlocked main profile portions 25 of upper seal member 12 and lower seal member 14. The seal member rib 56 serves to assist in preventing the main profile portions 25 of interlocked upper seal member 12 and lower seal member 14 from shifting or rotating toward lower seal member 14. Preferably, the rib end 58 of seal member rib 56 protrudes into lifting rib groove 26, thereby adding additional stability. Seal member rib 56 may be formed in a variety of shapes and may include a stiffener insert 54. Furthermore, seal rib member 56 may be configured to fit over (not shown) at least a portion of the profile section of upper seal member 12. In use, closure bar 48 of slider 16 passes through closure bar groove 32, deflecting seal member rib 56 outward away from the seal profile area until the upper seal member 12 is interlocked with the lower seal member 14. After the slider 16 passes a section of the profile, seal member rib 56 returns to a position that buttresses the seal profile, as shown in FIG. 9*o*.

Figure 10:
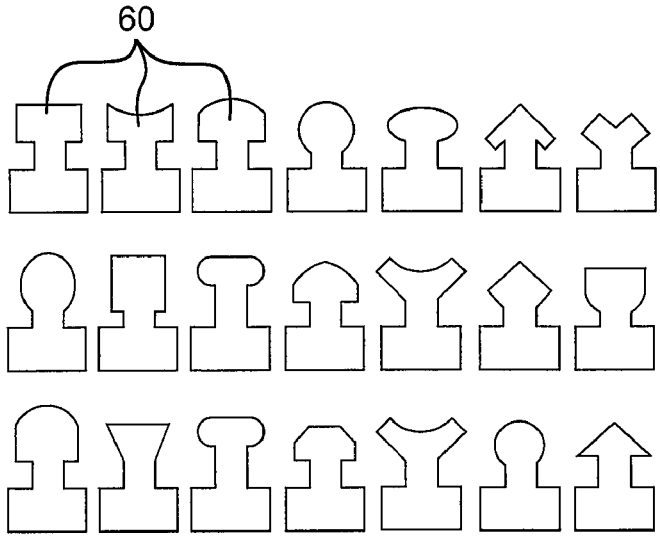
FIG. 10 is cross-sectional view showing a number of possible shapes for male mating surface members.
Figure 11:
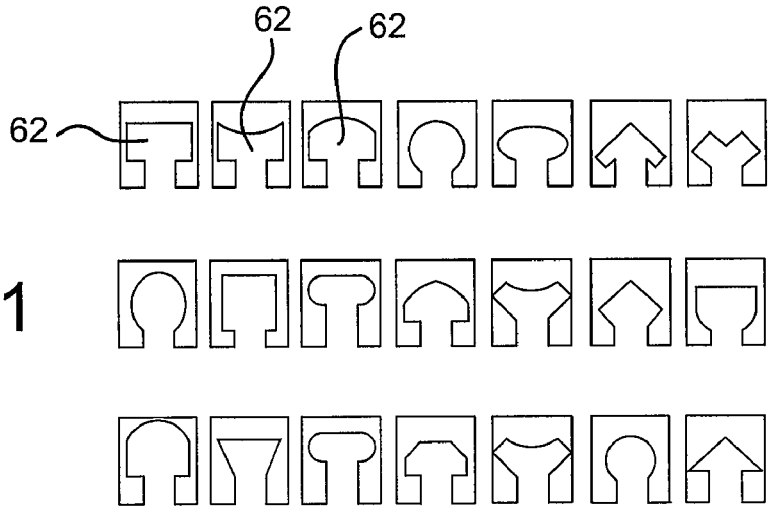
FIG. 11 is a cross-sectional view showing female mating surface members corresponding to those depicted in FIG. 10.
Figure 12:
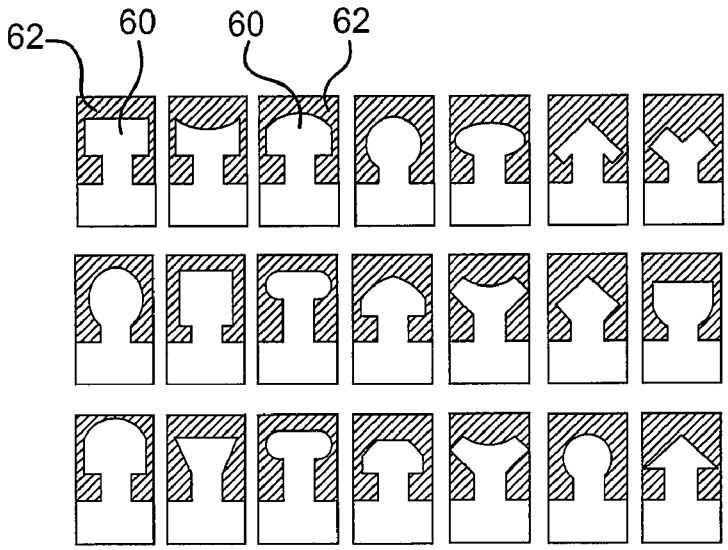
FIG. 12 is a cross-sectional view showing the combined male and female mating surface members depicted in FIGS. 10 and 11

As illustrated in FIG. 3, the seal is formed by forcing mating surface 20 of upper seal member 12 in interlocking contact with the mating surface 22 of lower seal member 14. Mating surfaces 20 and 22, therefore, are mating shapes that allow the two surfaces to interlock, thereby forming a seal. Each mating surface is formed of at least one, or alternatively, a plurality of male shapes 60 and female shapes 62 that mate with each other. Referring now to FIG. 10, various individual male mating shapes 60 are presented. As FIG. 10 illustrates, a wide range of male shapes 60 are possible. FIG. 11 illustrates a matching set of female shapes 62 that may be paired with the male shapes 60 to form interlocking pairs 64 of male shapes 60 and female shapes 62, as shown in FIG. 12. When forming a mating surfaces 20, 22, a different assortment of male shapes 60 and females shapes 62 may be used to form a plurality of shapes in one mating surface 20, 22, so long as each male shape 60 matches with a corresponding female shape 62. Thus, a wide variety of combinations of male shapes 60 and female shapes 62 may be used to create unique matched sets of mating surfaces 20 and 22. Furthermore, mating surfaces 20, 22 may include one, two, three, or a substantially greater number of male shapes 60 and female shapes 62. For example, the device 10 may have applications in the medical implant field where mating surfaces 20, 22 containing hundreds or thousands of tongue and groove, or male shapes 60 and female shapes 62 are desirable.

Referring now to FIG. 13, a variety of different complex shapes may be used to form male shapes 60. That is, for every male shape 60 depicted in FIG. 10, additional grooves or notches 64 may be made in those male shapes 60. As shown in FIG. 14, where male shapes 60 with notches 64 are used, corresponding female shapes 62 preferably include projections 66 to mate with the notches 64.

In addition to the above noted complex shapes that may be used, shape additions 68, such as those shown in FIG. 15, may be added to male shapes 60. Similarly, as shown in FIG. 16, female shapes 62 may be provided that also include additional shapes 68. Where used, the opposing mating surface 20 or 22 includes appropriate indentations or notches (not shown) to accommodate the shape additions 68.

Referring now to FIGS. 17.1-17.11, it is a further aspect of the present invention to provide mating surfaces 20 and 22 that include a variety of shapes 70 along the length of the male shapes 60, as may be desired. For illustration purposes, all of the shapes shown are male shapes 60. However, it is to be understood that corresponding female shapes 62 are preferably used to mate with the male shapes 60 that may incorporate a simple shape 70 anywhere along its length. FIG. 17.1 shows a simple shape 70 located on the top and the bottom of the male shape 60, but with no shape in the middle. The simple shape 70 shown is a half circle on each side of the male shape 60. However, it is to be understood that the simple shape 70 could take on any form, such as a rectangle, triangle, etc. FIG. 17.2 illustrates a male shape 60 having two different simple shapes 70 on either side at its top. FIG. 17.3 illustrates three simple shapes 70 stacked on top of each other along the length of male shape 60. FIGS. 17.4 through 17.9 illustrate several other possible combinations of simple shapes that may be used. Combinations other than those illustrated are possible and within the scope of the present invention. FIG. 17.10 illustrates that the male shape 60 may be curved. In addition, FIG. 17.11 illustrates that a curved male shape 60 may include a simple shape along its length, such as at its end. In sum, male shapes 60 may be contain notches 64, additional shapes 68, simple shapes 70 and/or curved members to create a mating surface 20, 22. Female shapes 62 preferably mate with male shapes 60, and incorporate appropriate shapes, such as projections 66, as may be required to mate with male shapes 60.

FIGS. 18*a* and 18*b* illustrate that a upper seal member 12 and lower seal member 14 may include male shapes 60 of variable height along their mating surfaces 20 and 22, respectively. In a preferred embodiment, a single mating surface is designed to mate with itself. More specifically, a single profile section is produced, cut, and flipped over to mate with itself and form a seal, as illustrated in FIG. 18*c*. Here, the single profile serves as both the upper seal member 12 and the lower seal member 14.

Referring now to FIGS. 19-20, a modification of the first embodiment is presented, wherein a modified slider 16' is used in combination with an upper seal member 12 and a lower seal member 14 to create a seal 17. Slider 16' features a closing portion 72 and an opening portion 74. As with slider 16, slider 16' is moved along the length of the seal 17 to either close or open the seal 17. In use, as slider 16' is moved along the seal profiles, the closing portion 72 closes the seal portion it passes. Conversely, when slider 16' is moved in the opposite direction, the opening portion 74 opens the seal portion it passes.

Closure of the seal 17 occurs at closing end 72 because upper seal member 12 is placed in confinement with lower seal member 14, thereby pressing mating surface 20 of upper seal member 12 into the mating surface 22 of lower seal member 14. More particularly, the mating surface 20 of upper seal member 12 is pressed into the mating surface 22 of lower seal member 14 by upper canted portion 76 of slider 16'. As this action occurs, lower seal member 14 is held in place by closure bar 48 of slider 16'.

Canted portion 76 may have a horizontal interior surface 78. However, canted portion 76 is preferably tilted, or set at a downward angle .alpha. relative to a horizontal plane. This downward angle .alpha. functions to rotate the upper seal member 12 as its mating surface 20 is pressed into mating surface 22 of lower seal member 14. This rotation of upper seal member 12 assists in allowing slider 16' to move more freely as it is used to zip the seal 17 closed or open. In addition, rotation of upper seal member 12 improves the air and water resisting characteristic of the seal in a closure state, by rotating the male shapes 60 into female shapes 62, thus improving the contact of their individual surfaces. Male shapes 60 and female shapes 62 used in conjunction with mating surfaces 20 and 22 that are sealed using slider 16' may contain notches 64, projections 66, additional shapes 68, simple shapes 70, as well as all other features previously described for mating surfaces 20, 22 and their component structures.

Referring now to FIG. 20, a series of partial cylindrical shapes 80 are provided for reducing friction between the upper canted portion 76 and the upper seal member 12. More specifically, the interior surface 78 of upper canted portion 76 preferably includes a series of partial cylindrical shapes 80 that contact the upper surface 47 of the main profile portion 25 of upper seal member 12. These cylindrical shapes 80 serve to reduce friction between the upper canted portion 76 and upper seal member 12 as upper seal member 12 contacts the upper canted portion 76. Partial cylindrical shapes 80 are also preferably used along at least a portion of closure bar 48 at the closure portion 72 of slider 16'. The cylindrical shapes 80 along the interior surface 82 of closure bar 48 reduce friction between the closure bar 48 and the lower seal member 14.

Slider 16' stabilizes and controls the position of lower seal member 14 using closure bar 48. The aspects of closure bar 48 used in conjunction with slider 16' encompass all of the permutations previously described. Without limitation, closure bar 48 may be relatively long, similar to that shown previously in FIG. 9*a*, or it may be very short and take on the appearance of a prong, as illustrated in FIG. 9*d*. It may also include an end shape 51 to assist in grabbing lower seal member 14. This is particularly useful if a relatively short or prong-shaped closure bar 48 is utilized. Regardless of its shape, as with slider 16, closure bar 48 functions to control the location of lower member 14 within slider 16'.

Referring again to FIGS. 19 and 20, opening portion 74 of slider 16' functions to separate upper seal member 12 from lower seal member 14 and open the seal 17. Opening portion 74 preferably includes one lifting rib 46'. Lifting rib 46' preferably extends in an inclined position from approximately the middle of slider 16' to the end of slider 16' at the opening portion 74 of the slider 16'. Opening portion 74 also includes closure bar 48, which preferably extends the entire length of the bottom of slider 16'. Closure bar 48 anchors the lower seal member 44 to the bottom of the slider 16'. As the slider 16' is moved in an opening direction in accordance with arrow 84 of FIG. 19, the combination of action of lifting rib 46' on upper seal member 12 and the closure bar 48 on lower seal member 14 pulls the two seal members 12 and 14 apart, thus opening the seal. The preferable use of one lifting rib 46' in slider 16' provides a rotation motion to the upper seal member 12 as it is separated from lower seal member 14. This rotation occurs because the side of the main profile portion 25 adjacent the lifting rib 46' is lifted before the side of the main profile portion 25 opposite the lifting rib 46'. The rotational feature provides for smoother separation of the upper seal member 12 from the lower seal member 14, and also tends to improve the longevity of seal performance because less friction is induced between the upper seal member 12 and lower seal member 14 during opening. Lifting rib 46' may be shaped like a rail, or it may be wedge shaped, as shown in FIG. 20.

Referring now to FIG. 21, an example of a seal 17 comprising upper seal member 12 and lower seal member 14 is shown. Lifting groove 26 is formed under lifting wing 24 at the edge of the main profile portion 25 of upper seal member 12. Lifting groove 26 receivingly accepts lifting rib 46' of slider 16'. FIG. 21 also illustrates closure bar groove 32 within lower seal member 14.

The various seal configurations depicted in FIGS. 9*a* through 9*o* are applicable to use with slider 16'. More specifically, in addition to the features already discussed, such as closure bar 48 characteristics and profile mating surfaces 20, 22, slider 16' may utilize alternate configurations and features than are shown in FIG. 21. For example, slider 16' may incorporate a single top mounted lifting rib (see FIG. 9*i*), or a side and top mounted lifting rib (see FIG. 9*j*). Portions of upper seal member 12 beyond the main profile portion 25 may be at the same elevation or a different elevation than lower seal member 14. Stiffener inserts 54 may also be used in lower seal member 14 when using slider 16'.

Referring now to FIGS. 22 and 23, lifting rib 46' is prevented from separating upper seal member 12 from lower seal member 14 by cutting and removing the lifting wing 24 from the upper seal member 12 at the end portion of 30 of seal 17. Since lifting wing 24 is absent, the opening portion 74 of slider 16' is unable to grasp the underside of upper seal member 12 and cause it to separate from lower seal member 14. This aspect of the invention enables a seal 17 to be formed upon closure, because the entire length of the upper seal member 12 creates a fluid barrier with lower seal member 14.

Figure 24:
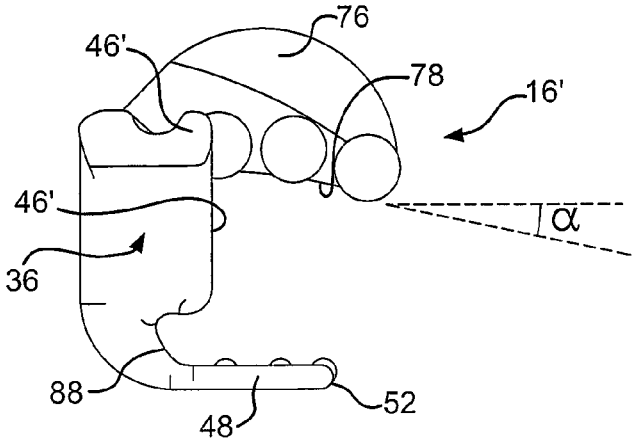
FIG. 24 is an elevation view of the modified slider of FIG. 20 looking toward the opening portion of the slider.

FIG. 24 provides an elevation view of slider 16' looking toward the front or opening portion 74 the slider 16'. This view further illustrates lifting rib 46' rising in the foreground on an angle from the middle of slider 16' to the front end of slider 16'. Preferably, a groove 88 is formed in slider 16' to assist in retaining lower seal member 14 during opening of the seal 17.

Figure 25:
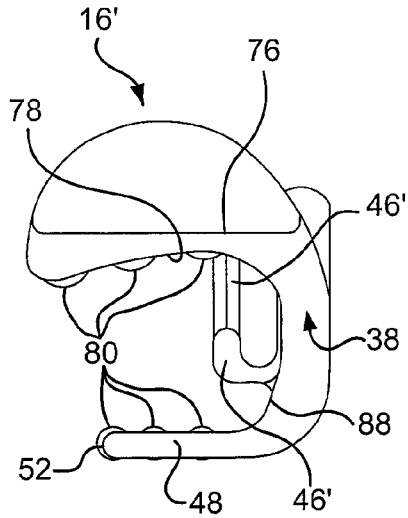
FIG. 25 is an elevation view of the modified slider of FIG. 20 looking toward the closing portion of the slider.

Referring now to FIG. 25, a rear elevation view of slider 16' is provided. This view depicts the slider 16' looking toward the closing portion 72. Again, lifting rib 46' is shown rising toward the top of slider 16'.

Figure 26:
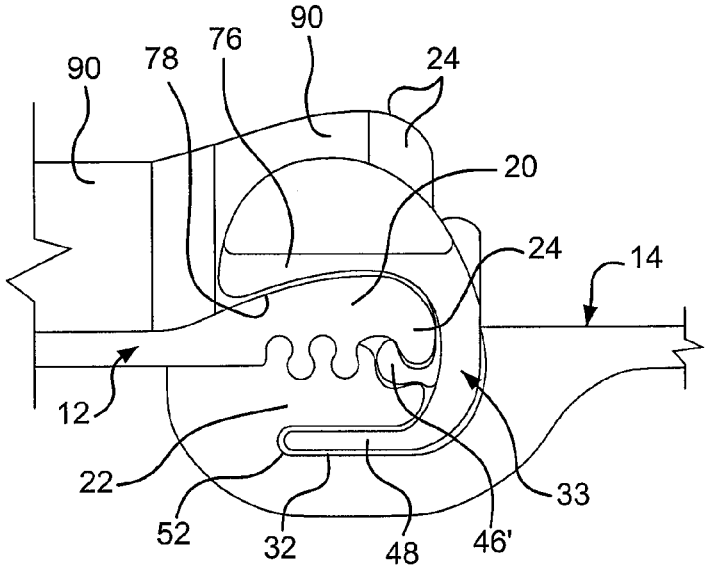
FIG. 26 is an elevation view of the modified slider of FIG. 20 with upper and lower seal profiles looking toward the closing portion of the slider.

FIG. 26 depicts the same rear elevation view as shown in FIG. 25, but with an upper seal member 12 and a lower seal member 14 disposed within the slider 16'. This view also depicts lifting wing 24 of upper seal member 12 disposed over lifting rib 46'. Closure bar 48 anchors lower seal member 14 within slider 16', and also provides confinement in conjunction with canted portion 76 at the closing end 38 of slider 16' to press mating surface 20 of upper seal member 12 into interlocking position with mating surface 22 of lower seal member 14. A top surface 90 of upper seal member 12 is shown rising in the background of the slider 16' as the upper seal member 12 is forced open at the front end of the slider.

Figure 27:
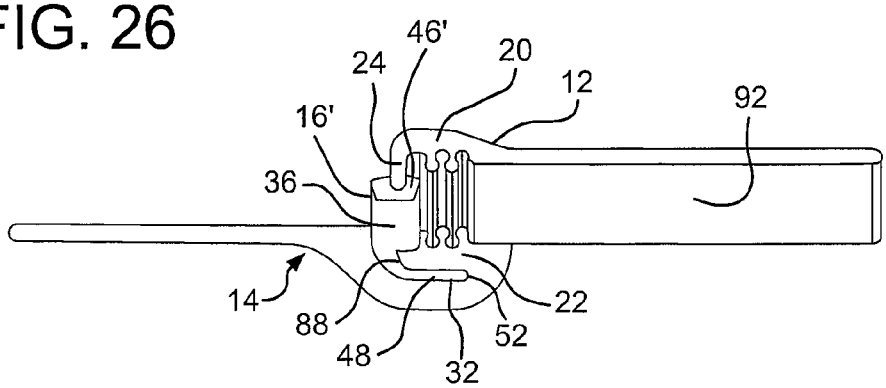
FIG. 27 is an elevation view of the modified slider of FIG. 20 with upper and lower seal profiles looking toward the opening portion of the slider.

In contrast to FIG. 26, a front elevation view of slider 16' with upper seal member 12 and lower seal member 14 is shown in FIG. 27. Here, the function of the opening portion 74 of slider 16' is illustrated. Upper seal member 12 has been pulled apart from lower seal member 14 at the opening end 36 of slider 16', thereby exposing the bottom surface 92 of upper seal member 12.

In a further embodiment, the present invention includes a device for sealing a first edge of a first surface of an object with a second edge of a second surface of the object where the first edge is oriented substantially parallel to the second edge, the first and second surfaces are substantially coplanar, and the first surface extends in a direction opposite the second surface. The device includes an upper seal member, a lower seal member, a slider and a plug. The upper seal member is attached to the first edge and has a first mating surface. The lower seal member is attached to the second edge and has a second mating surface. The second mating surface and the first mating surface are releasably interlockable. The slider has a body, a slider interior structure and an exterior tongue and groove portion. The body includes an opening end and a closing end, with the closing end having a confining portion in which the first mating surface of the upper seal member is placed into interlocking contact with the second mating surface of the lower seal member. The slider interior structure cooperates with the first mating surface of the upper seal member, and cooperates with the second mating surface of the lower seal member. The plug has a plug interior structure, and an exterior tongue and groove portion. The plug interior structure cooperates with the first mating surface of the upper seal member, and cooperates with the second mating surface of the lower seal member. In a closing position, the plug interior structure interlocks with the slider interior structure, and the exterior tongue and groove portion of the plug interlocks with the slider tongue and groove portion. When the slider is moved in a direction causing the upper seal member and the lower seal member to pass within the slider from the opening end to the closing end, the slider confines the first mating surface into contact with the second mating surface thereby creating a seal.

FIGS. 28-31 illustrate this embodiment of the seal device 100. Seal device 100 includes an upper seal member 12, a lower seal member 14, a slider 102 and a plug 104. Slider 102 includes a pull tab 40, pin 42 and pull tab track 44. It is an aspect of this embodiment to provide sealing device 100 that may be locked. Accordingly, pull tab 40 preferably includes an aperture 106 that receivingly accepts lock receptacle 108 of plug 104 when the slider 102 is in its closed position. More specifically, plug 104 is a permanent stop that is affixed to the end of seal 17. To close seal 17, slider 102 is zipped down the sealing profile 17 of upper seal member 12 and lower seal member 14, thereby interlocking mating surface 20 of upper seal member 12 with mating surface 22 of lower seal member 14. Slider 102 is then brought into to its mating closure position 110 with plug 104, as will be discussed in detail below. Pull tab 40 is then secured with lock receptacle 108 of plug 104 by placing pull tab 40 in a forward position such that lock receptacle 108 passes through aperture 106 of pull tab 40. Lock receptacle 108 includes a hole 112 that is sized to receive a common travel lock (not shown).

Figure 28:
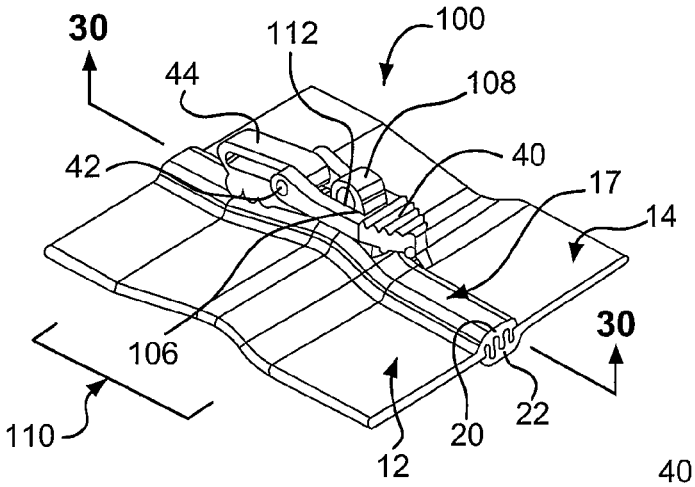
FIG. 28 is a perspective view of a second embodiment of the present invention.
Figure 29:
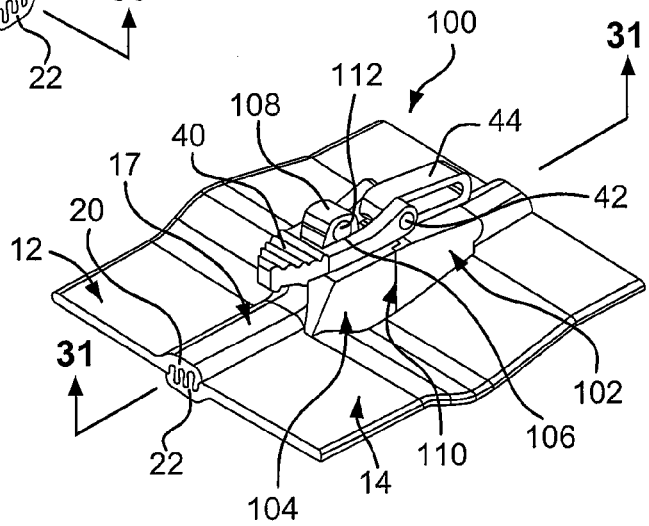
FIG. 29 is an alternate perspective view of the second embodiment of the present invention.

Referring again to FIGS. 28 and 29, two perspective views of seal 100 are shown. FIGS. 28 and 29 depict slider 102 in its closure position 110 with plug 104, whereby slider 102 and plug 104 make a seal 17 at the end of the seal profile 110.

Figure 30:
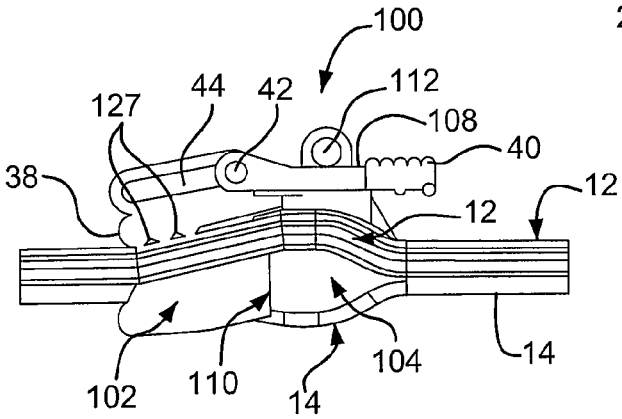
FIG. 30 is a cross sectional view taken along line 30-30 of FIG. 28.

FIG. 30 is a cross-sectional view of seal device 100 taken at the side of upper seal member 12 along line 30-30 of FIG. 28. FIG. 30 illustrates the disposition of upper seal member 12 and lower seal member 14 when slider 102 is in its closure position 110 with plug 104. Here, upper seal member 12 and lower seal member 14 are shown separated within the zone occupied by the slider 102 and plug 104. Here, upper seal member 12 and lower seal member 14 form a hydraulic and vapor barrier with the interior structure of slider 102 and plug 104, as will be discussed below.

Figure 31:
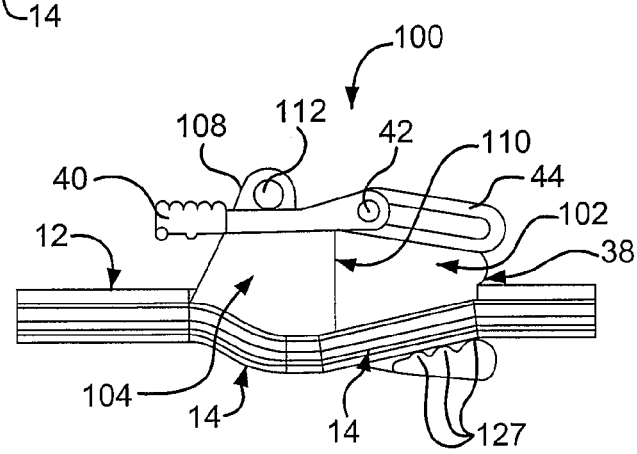
FIG. 31 is a cross sectional view taken along line 31-31 of FIG. 29.

FIG. 31 is a cross-sectional view of seal device 100 taken at the side of lower seal member 14 along line 31-31 of FIG. 29. That is, FIG. 31 illustrates the opposite side of slider 102/plug 104 coupling as compared to the cross section depicted in FIG. 30. In FIG. 31, lower seal member 14 is shown separated from upper seal member 12 in the zone occupied by the slider 102 and plug 104.

Figure 32:
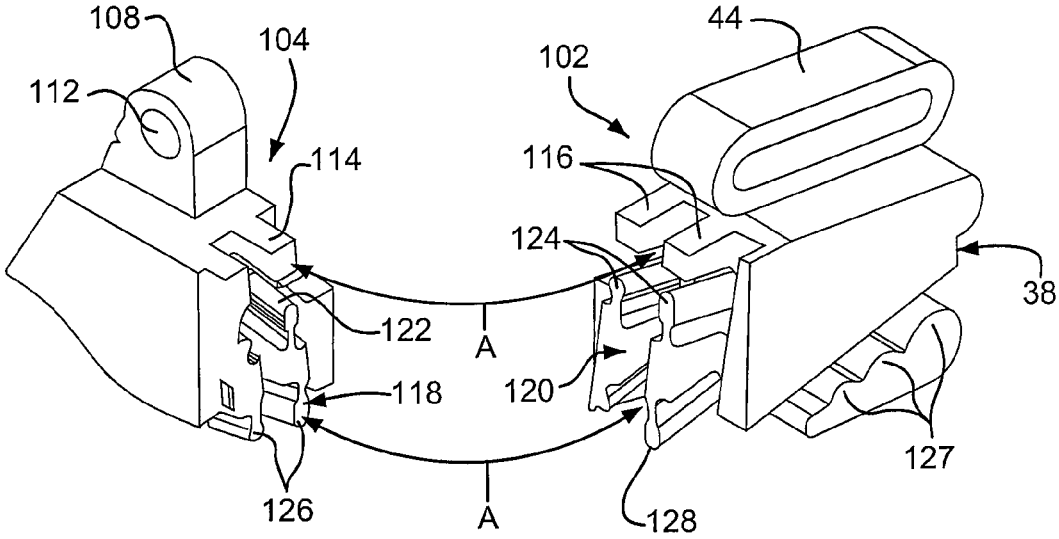
FIG. 32 is a perspective view of the plug and slider of the second embodiment.

Referring now to FIG. 32, the exterior and interior mating structure of plug 104 and slider 102 are shown. More specifically, plug 104 includes exterior tongue and groove portion 114, that couples with exterior tongue and groove portion 116 of slider 102 when the slider 102 and plug 104 are set in their closure position 110. That is, slider 102 and plug 104 are interlocked by inserting slider 102 with plug 104 in accordance with arrows A. Furthermore, the interior structure 118 of plug 104 is shaped to cooperate and interlock with the mating surface 20 of upper seal member 12 and lower seal member 14. Likewise, the interior structure 120 of slider 102 is shaped to cooperate and interlock with the mating surface 22 of lower seal member 104. In addition, the interior structure 118 of plug 104 interlocks with the interior structure 120 of slider 102. A seal is formed when slider 102 and plug 104 are in their closure position 110, because (1) mating surface 20 of upper seal member 12 forms a hydraulic seal with top portion 122 of interior structure 118 of plug 104, and also forms a hydraulic seal with the top portion 124 of the interior structure 120 of slider 102, and (2) because the mating surface 22 of lower seal member 14 forms a hydraulic seal with the bottom portion 126 of interior structure 118 of plug 104, and also forms a hydraulic seal with the bottom portion 128 of the interior structure 120 of slider 102.

Figure 33:
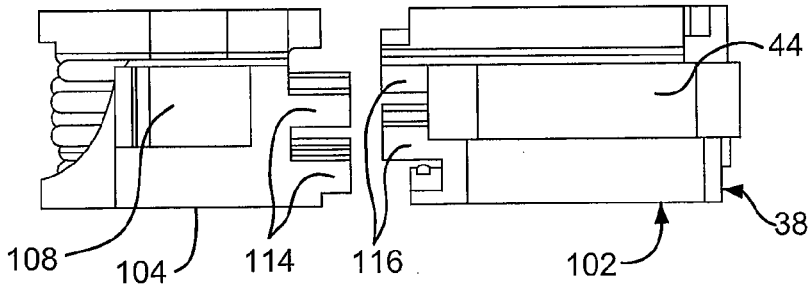
FIG. 33 is a plan view of the plug and slider depicted in FIG. 32.

Referring to FIGS. 31-32 closure bumps 127 are provided for reducing friction with upper seal member 12 and lower seal member 14. More particularly, closure bumps 127 are preferably cylindrical shaped and reduce friction between slider 102 and upper seal member 12 and lower seal member 14 when slider 102 is moved down the length of seal 17, because seal members 12 and 14 only touch the closure bumps tangentially as the slider 102 is moved. Referring now to FIG. 33, a top plan view of slider 102 and plug 104 is shown. This view illustrates the exterior tongue and groove portion 114 of plug 104, that couples with exterior tongue and groove portion 116 of slider 102 when slider 102 is placed in its closure position 110 with plug 104.

Figure 34:
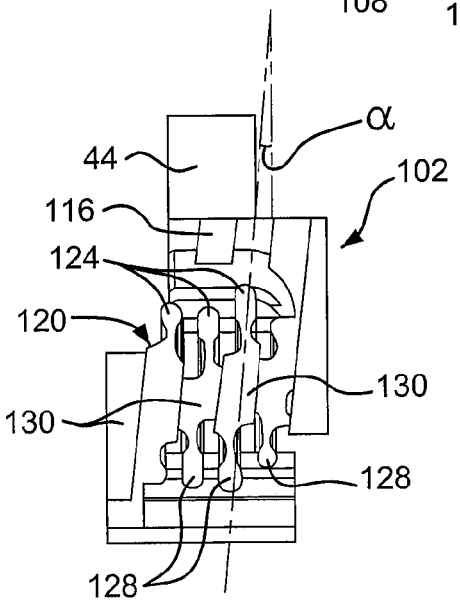
FIG. 34 is a front elevation view of the slider depicted in FIG. 32.

Referring now to FIG. 34, the interior structure 120 of slider 102 is shown in a front elevation view. This view illustrates that the interior structure 120 of slider 102 is formed to interlock with the mating surfaces 20 and 22 of upper seal member 12 and lower seal member 14, respectively. Furthermore, individual struts 130 of interior structure 120 are situated at an angle .theta., that permits a male portion of a strut 130 to intercept a female shape 62 of mating surface 20 of upper seal member 12 and a female portion 62 of mating surface 22 of lower seal member 14. This aspect of the invention provides increased stability and strength to the interior structure 120 of slider 102.

Preferably, seal 100 is used in conjunction with a variable height profile mating shape. That is, preferably, the male shapes 60 and female shapes 62 of the mating surfaces 20 and 22 of the upper seal member 12 and lower seal member 14 are set at different heights. For example, the mating profile shape shown in FIG. 18*c* is a preferred profile to use with sealing device 100 to aid in water and air resistance as the upper seal member 12 and lower seal member 14 are closed together at the closing end 38 of slider 102.

Figure 35:
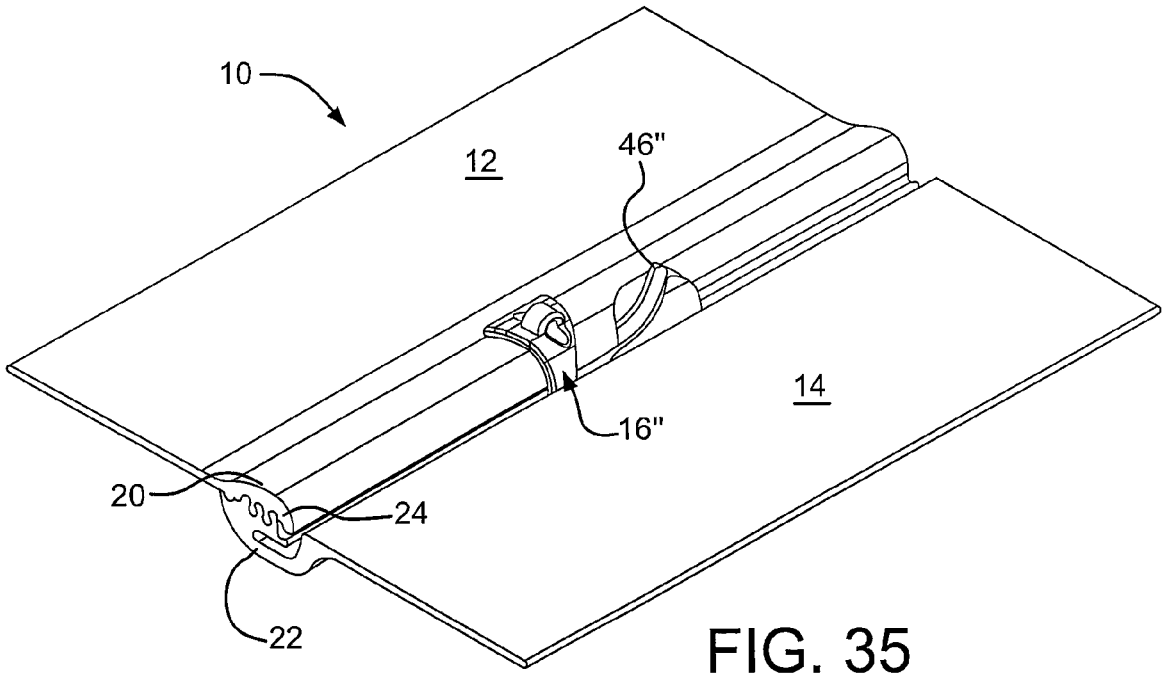
FIG. 35 is a perspective view of a sealing device in accordance with at least one embodiment of the present invention.
Figure 36A:
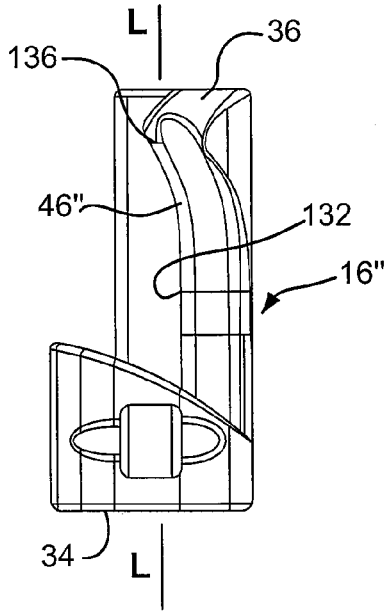
FIG. 36*a* is a plan view of the slider of FIG. 35.
Figure 36B:
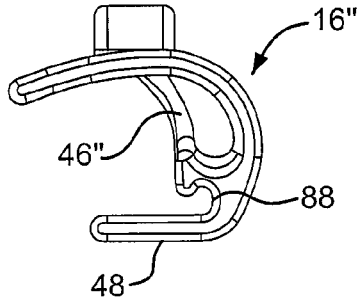
FIG. 36*b* is a side elevation view of the slider of FIG. 35.
Figure 39:
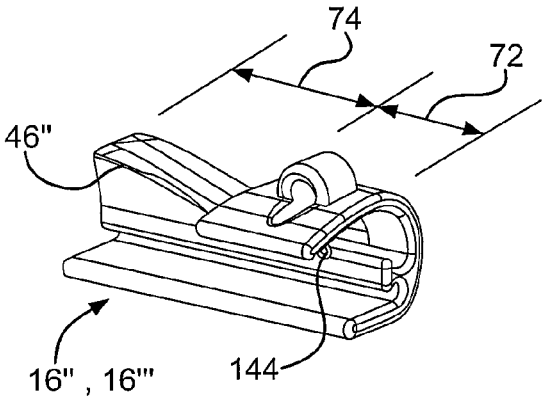
FIG. 39 is a side perspective view of the slider shown in FIGS. 37 and 38.

Referring now to FIGS. 35-36*b*, and in accordance with at least one embodiment of the present invention, a modified slider 16" is provided that comprises a curved lifting rib. More particularly, FIG. 35 illustrates a sealing device 10 comprising an upper seal member 12, a lower seal member 14 and modified slider 16", wherein the slider 16" includes a longitudinal axis L-L. As with slider 16', the lifting rib 46" of slider 16" extends from an intermediate position of slider 16" to a location at or near opening end 34 of the slider 16" in the area of the opening portion 74 of the slider. The area of the opening portion 74 of the slider is shown in FIG. 39. The lifting rib 46" also curves along its longitudinal length between these positions, and more preferably, the lifting rib 46" curves radially inward toward the longitudinal axis L-L from the first intermediate position 132 within the slider 16" to second end position 136 at or near the opening end 36 of the slider 16". Thus, the lifting rib 46" curves both upward and inward. The curvature of the lifting rib 46" provides for smoother operation of the slider 16" because the interlocking shapes 60 of the mating surfaces 20, 22 rotate during operation of the slider 16", thereby creating less friction as they contact each other upon closing and also while disengaging from each other while opening. More particularly, the lifting rib 46" lifts the lifting wing 24 of the upper seal member 12 and allows the upper seal member 12 to smoothly disengage from the lower seal member 14 in a rotational or peel oriented separation. Such a curved lifting rib 46" purposefully misaligns the upper and lower sealing members 12 and 14 at least along a portion of the length of the slider 16", yet advantageously provides smoother engagement and disengagement of the sealing members 12 and 14 by rotating the male and female shapes together and apart. In addition, the curved lifting rib 46" allows a smaller lifting rib to open a larger width profile, therefore, allowing for a more compact slider.

Figure 37:
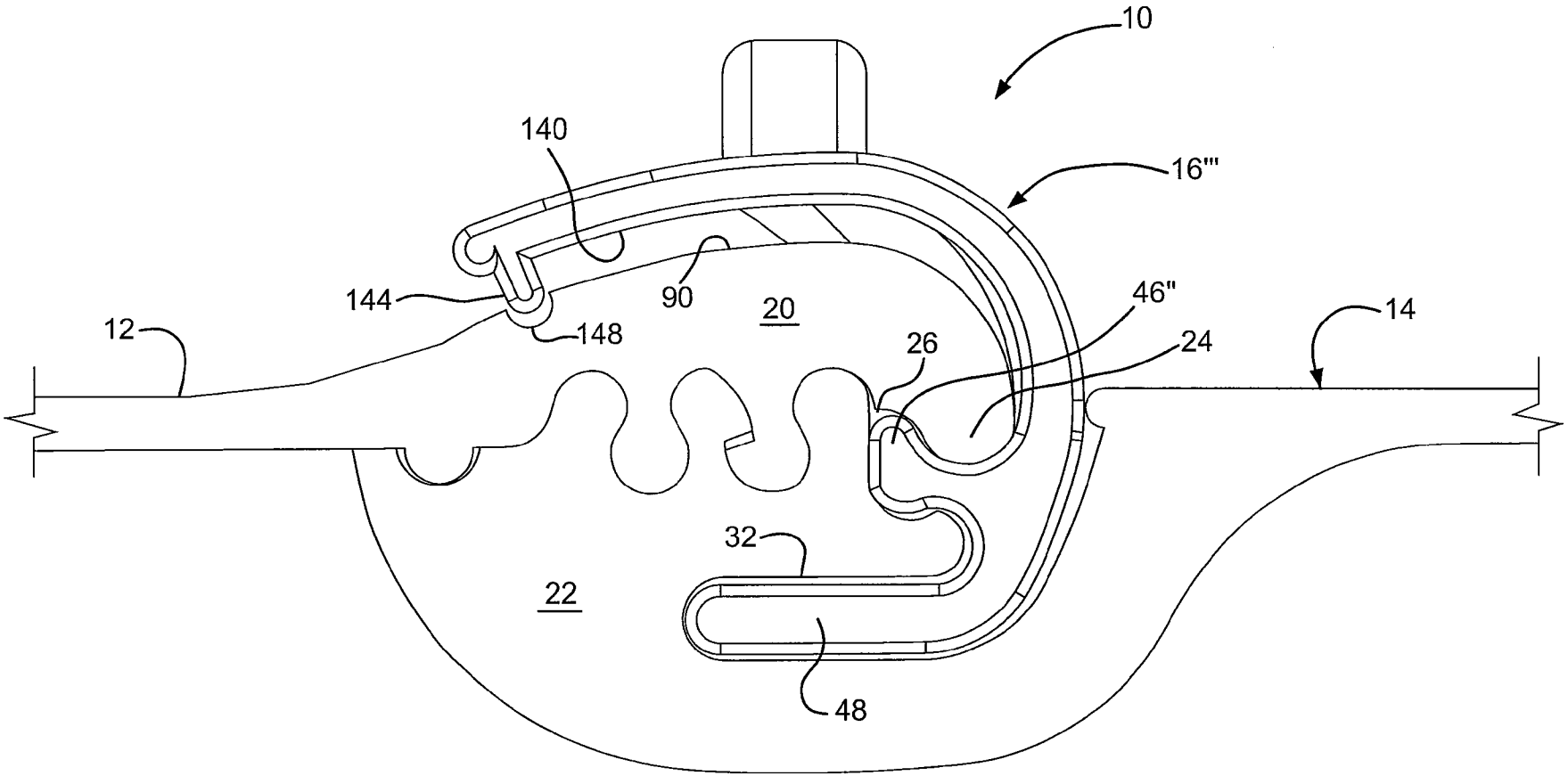
FIG. 37 is a side elevation view of a modified slider, as well as upper and lower seal members in accordance with embodiments of the present invention.
Figure 38:
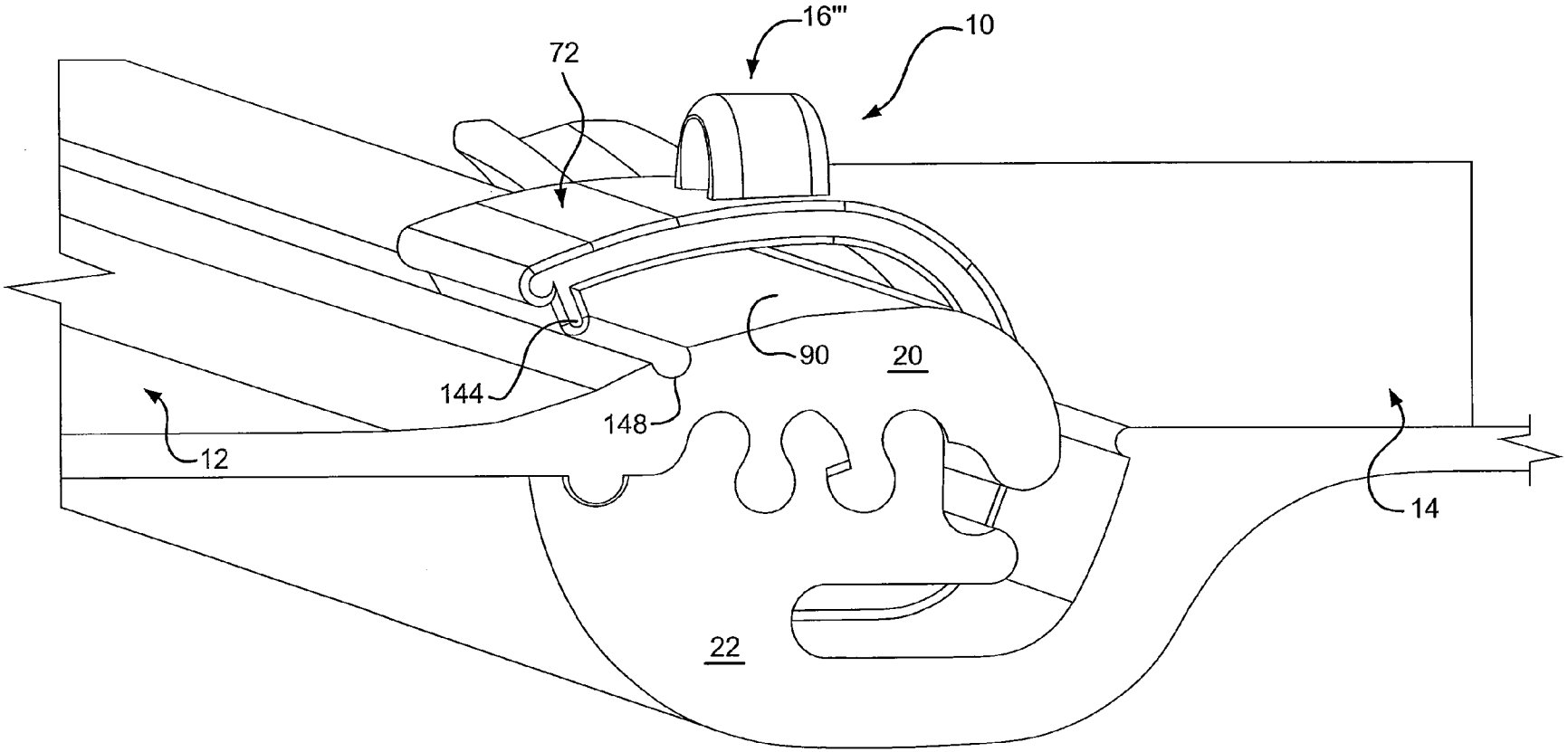
FIG. 38 is a perspective view of the sealing device shown in FIG. 37.

Referring now to FIGS. 37 and 38, and in accordance with at least some embodiments of the present invention, a sealing device 10 is provided that comprises a slider 16'" having a male rib 144 on its upper inner surface 140 in the area of the closing portion 72 of the slider 16'". The area of the closing portion 72 of the slider is shown in FIG. 39. The male rib 144 is received by a female groove 148 located along a top surface 90 of upper seal member 12. The male rib 144 and corresponding female groove 148 assist in maintaining the slider's ability to stay on the path of the sealing members 12 and 14.

Figure 41:
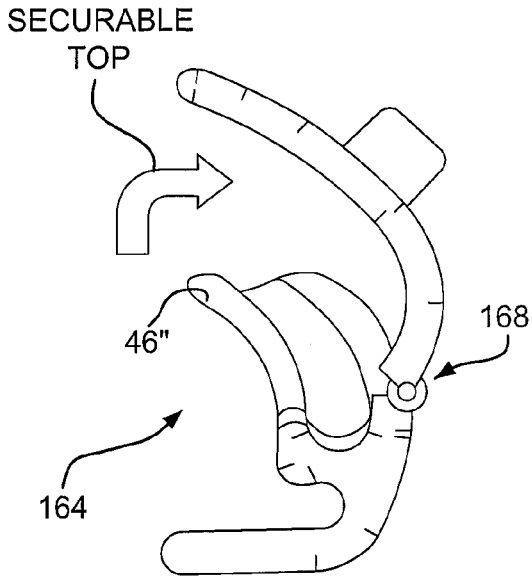
FIG. 41 is a front elevation view of a slider with a locking hinge for use with the endless sealing members shown in FIG. 40.
Figure 40:
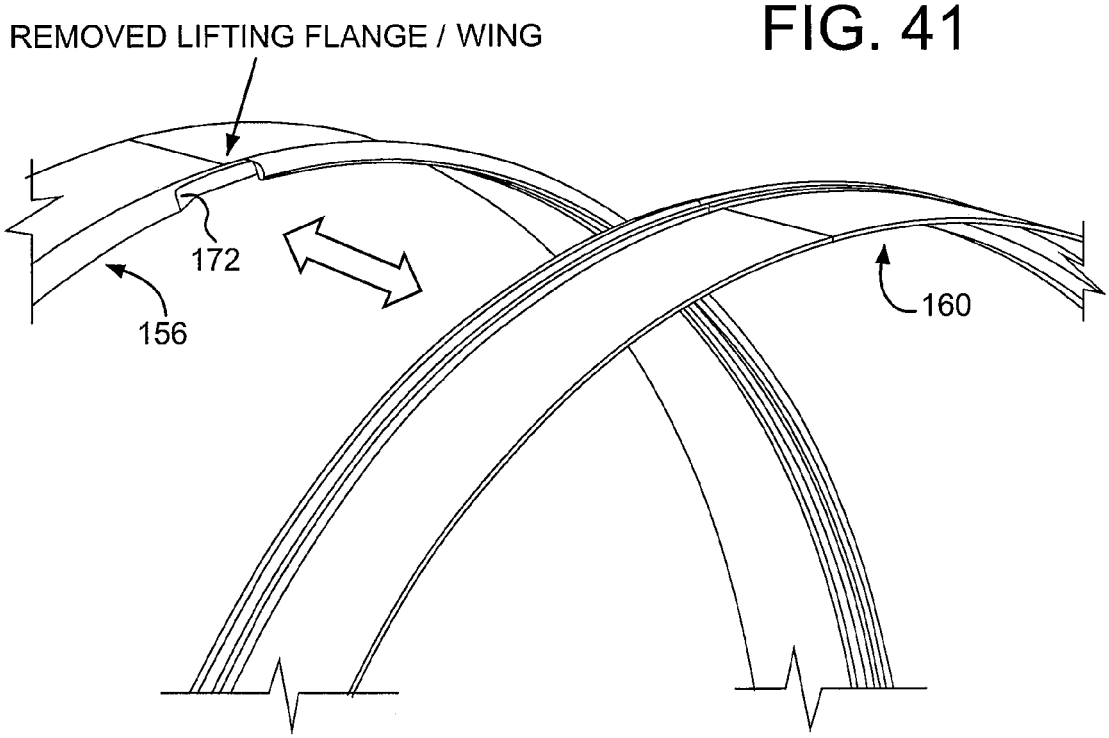
FIG. 40 is a perspective view of endless sealing members in accordance with embodiments of the present invention.

Referring now to FIGS. 40-43, in a separate embodiment of the invention, an endless sealing device 152 is provided. More generally, in accordance with at least one embodiment, an endless closure device is provided. The following endless closure embodiments described in detail herein are directed to an endless seal for purposes of illustrating a preferred embodiment. Thus, as best seen in FIG. 40, an endless sealing device 152 includes an endless upper sealing member 156 (similar in structure to upper sealing member 12, but continuous or endless in shape) and an endless lower sealing member 160 (similar in structure to lower sealing member 14, but continuous endless in shape). The endless upper and lower sealing members 156 and 160 may be formed into their endless shape by a variety of methods, such as by way of example and not limitation, attaching a first end of a seal member 156 to a second end of the seal member 156, or by injection molding the sealing member 156 or 160. As shown in FIG. 41, a locking hinge slider 164 is used to engage and disengage the endless sealing members 156 and 160. In accordance with at least one embodiment of the present invention, the locking hinge slider 164 may be similar in structure to other sliders described herein, such as sliders 16" and 16'", but preferably includes a releasably securable or lockable top with a hinge 168, that permits the slider top to be raised and lowered. As those skilled in the art will appreciate and understand, the releasably lockable top with a hinge 168 is but one possible opening slider structure, and thus, the opening slider may comprise a variety of configurations, including a top that is removable and snaps back or is otherwise secured onto the body of the slider 164. Thus, the releasably lockable top with hinge 168 is just one means for releasably securing a slider top to the slider 164.

In accordance with embodiments of the invention, the slider 164 may have a curved shape substantially matching the curvature of the endless sealing members 156, 160. By way of example and not limitation, a slider used to seal a glove to a biological suit may have a greater curvature than a slider used to seal a tent.

Figure 42A:
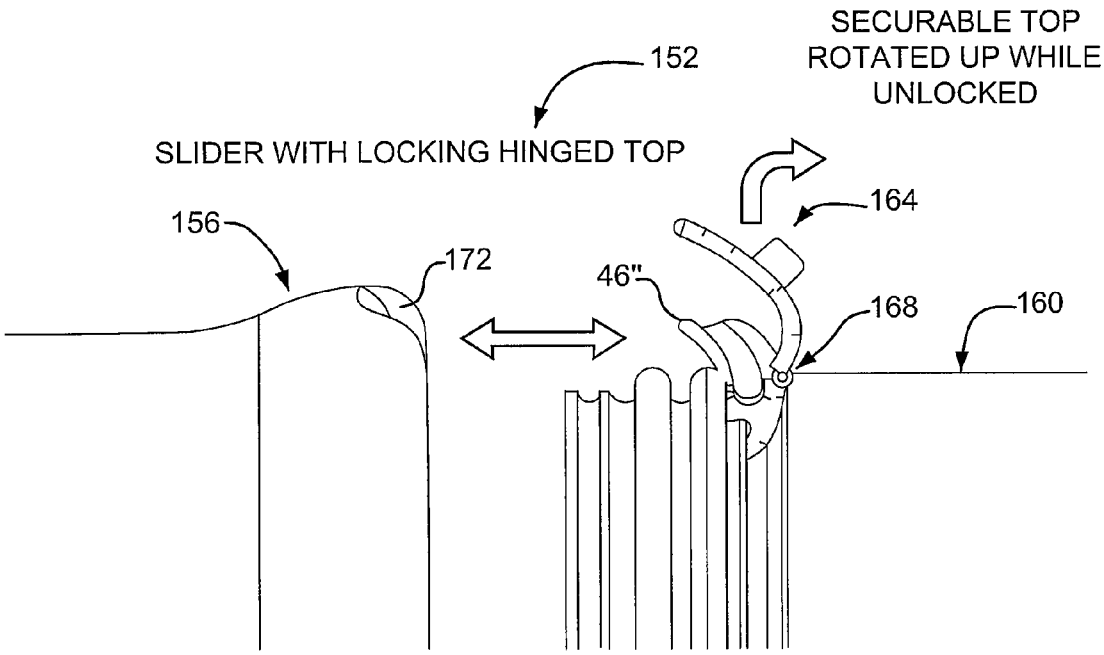
FIG. 42*a* is a partial side elevation view of the endless sealing members of FIG. 40 and slider of FIG. 41 as the components are being assembled for sealing engagement.
Figure 42B:
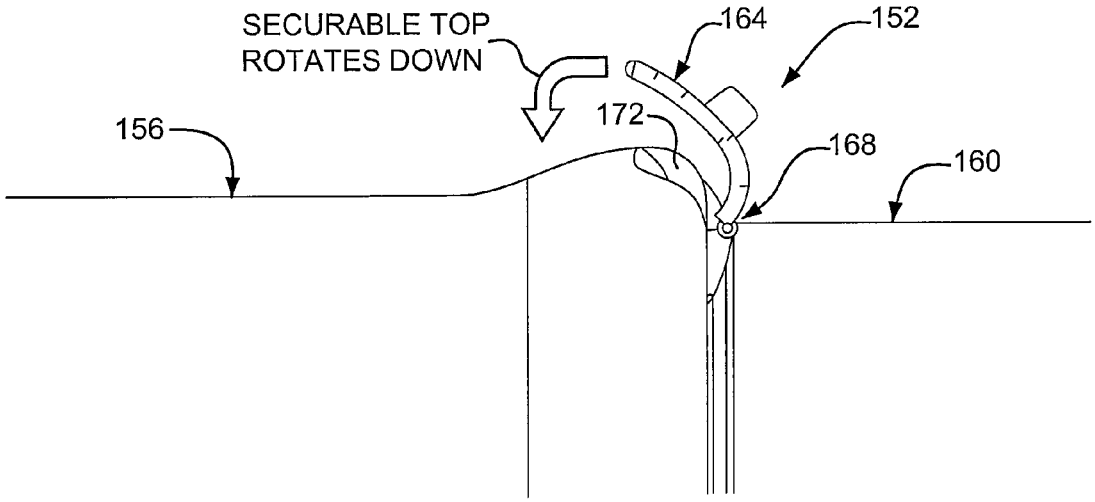
FIG. 42*b* is a partial side elevation view of the components shown in FIG. 42*a*, wherein the endless sealing members are being engaged.
Figure 42C:
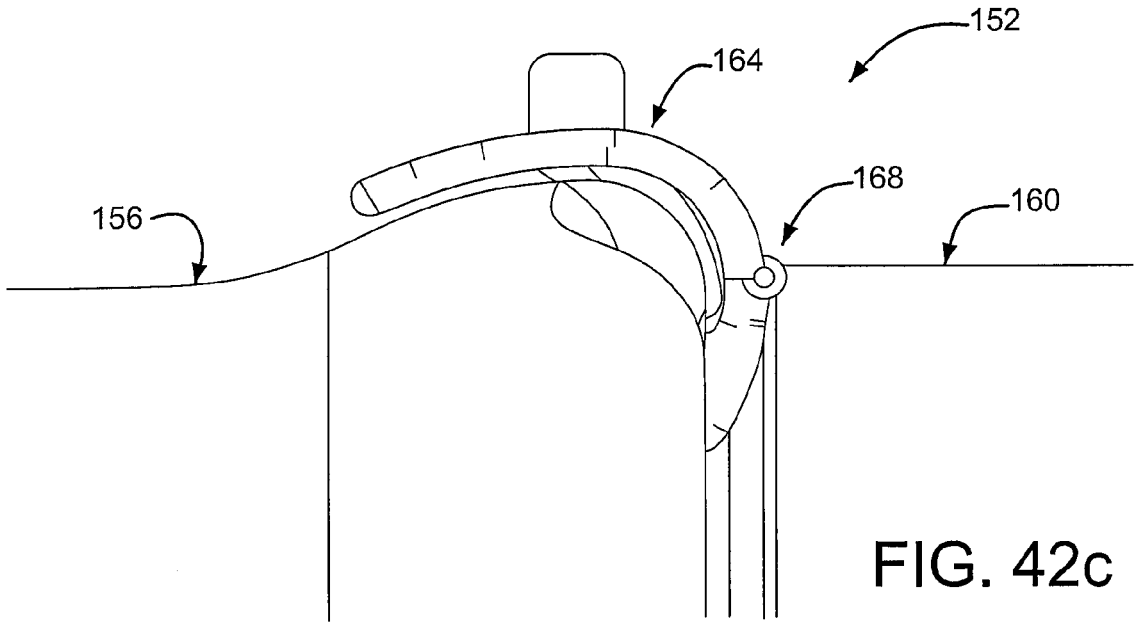
FIG. 42*c* is a partial side elevation view of the components of FIG. 42*b* with the locking hinge in its locked position.
Figure 43:
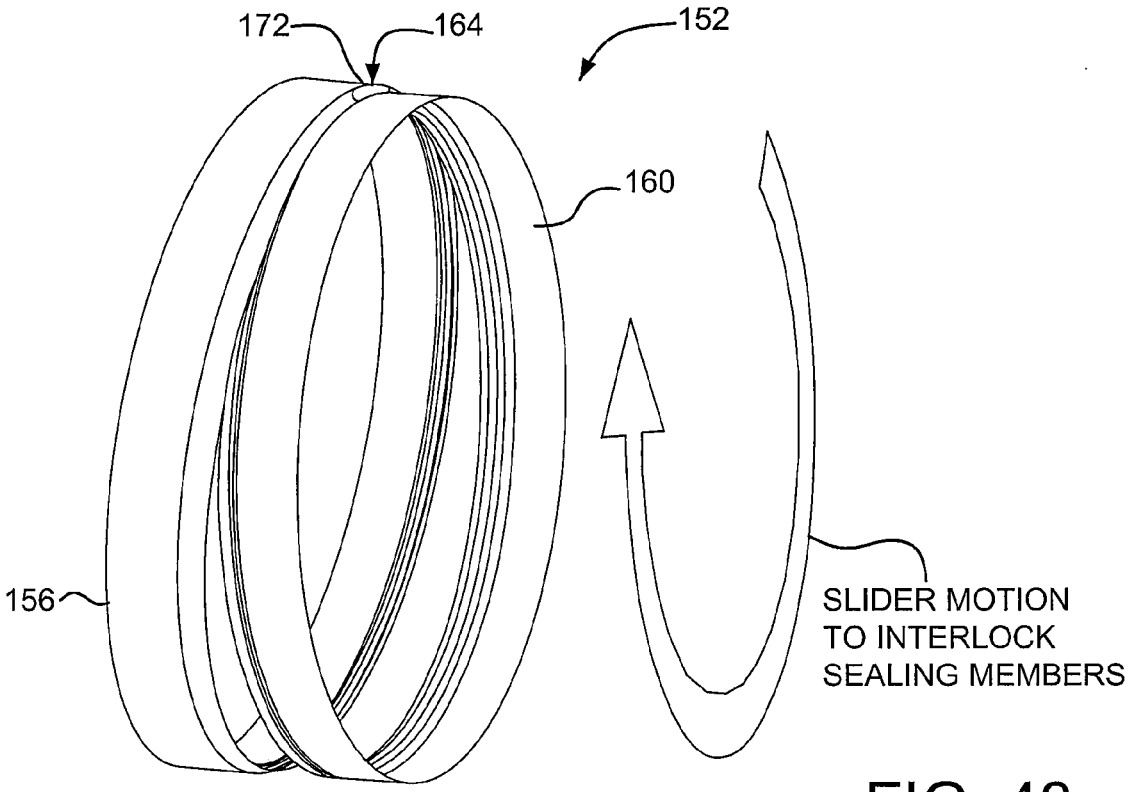
FIG. 43 is a perspective view of the endless sealing members and slider illustrating the slider motion to form a seal.

Referring now to FIG. 42*a*, prior to sealing endless sealing device 152, the endless upper and lower sealing members 156 and 160 are first positioned near each other. With the releasably lockable top with a hinge 168 in an open position, the endless upper sealing member 156 is then moved to substantially engaging alignment with the endless lower sealing member 160 in the vicinity of the slider 164. As shown in FIG. 42*b*, the releasably lockable top with a hinge 168 is then rotated to a locking position as shown in FIG. 42*c*, thereby engaging the interlocking shapes 60 of the mating surfaces 20, 22 of endless sealing members 156 and 160. As shown in FIG. 43, the slider 164 is then advanced around the circumference of the endless sealing members 156 and 160 to form an endless seal, wherein the endless seal may be substantially circular in cross section. As best seen in shown in FIG. 40, the endless upper sealing member 156 includes a gap section 172 wherein the lifting wing 24 has been removed, thereby allowing the slider 160 to seal the entire circumference of the object to which the endless sealing device 152 is attached.

In accordance with embodiments of the present invention, and as those skilled in the art will appreciate, the endless sealing device 152 has a variety of possible applications, including, but not limited to: access openings, head coverings, cuffs, gloves, and/or boots attachments for chemical and/or biological suits; zip-in neck seals for dry suits; tent openings and/or tent interconnection openings; and encapsulating coverings, closures and/or bags.

Figure 44A:
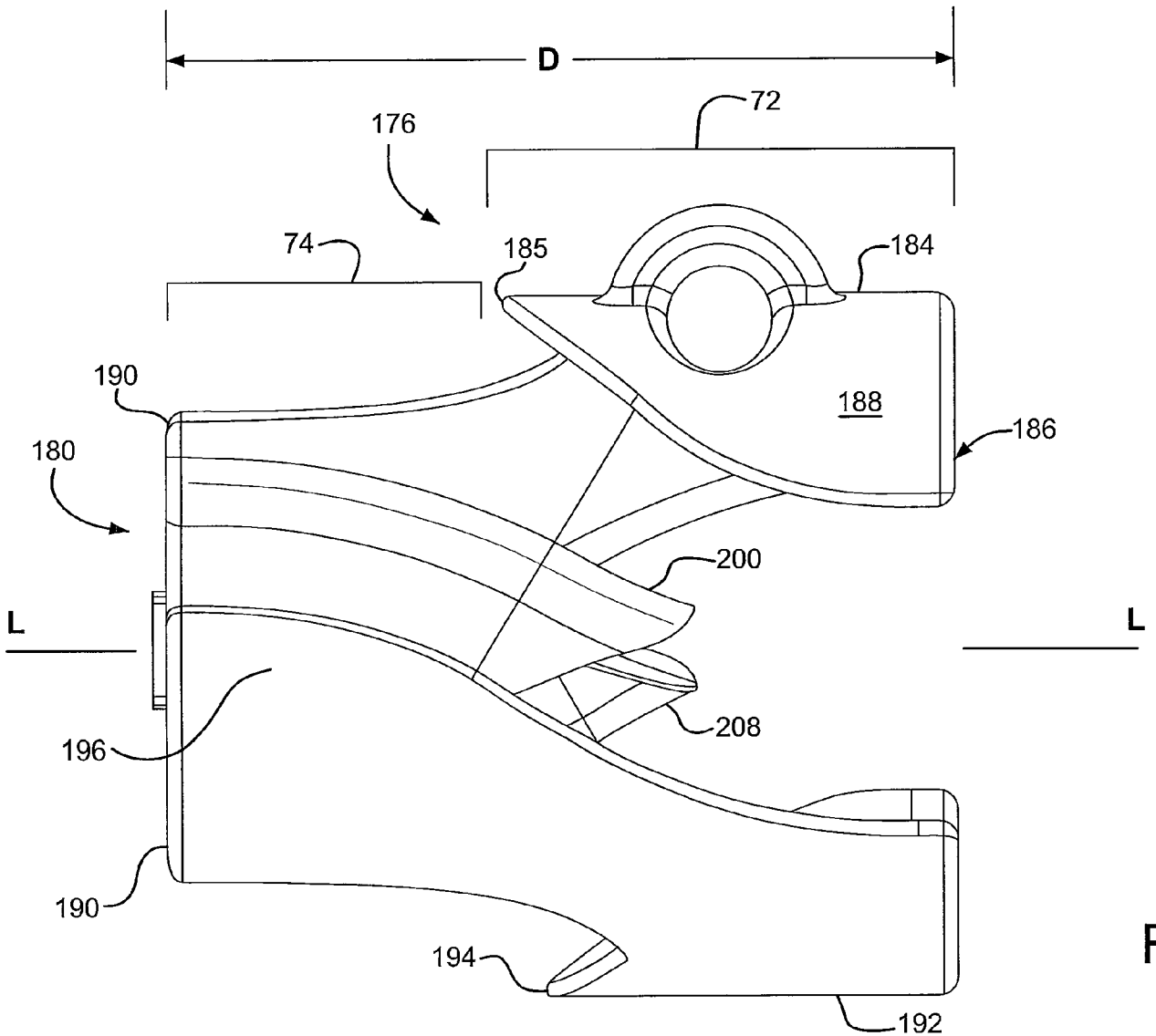
FIGS. 44*a* and 44*b* are opposite side elevation views of a separated block slider in accordance with embodiments of the present invention.
Figure 44B:
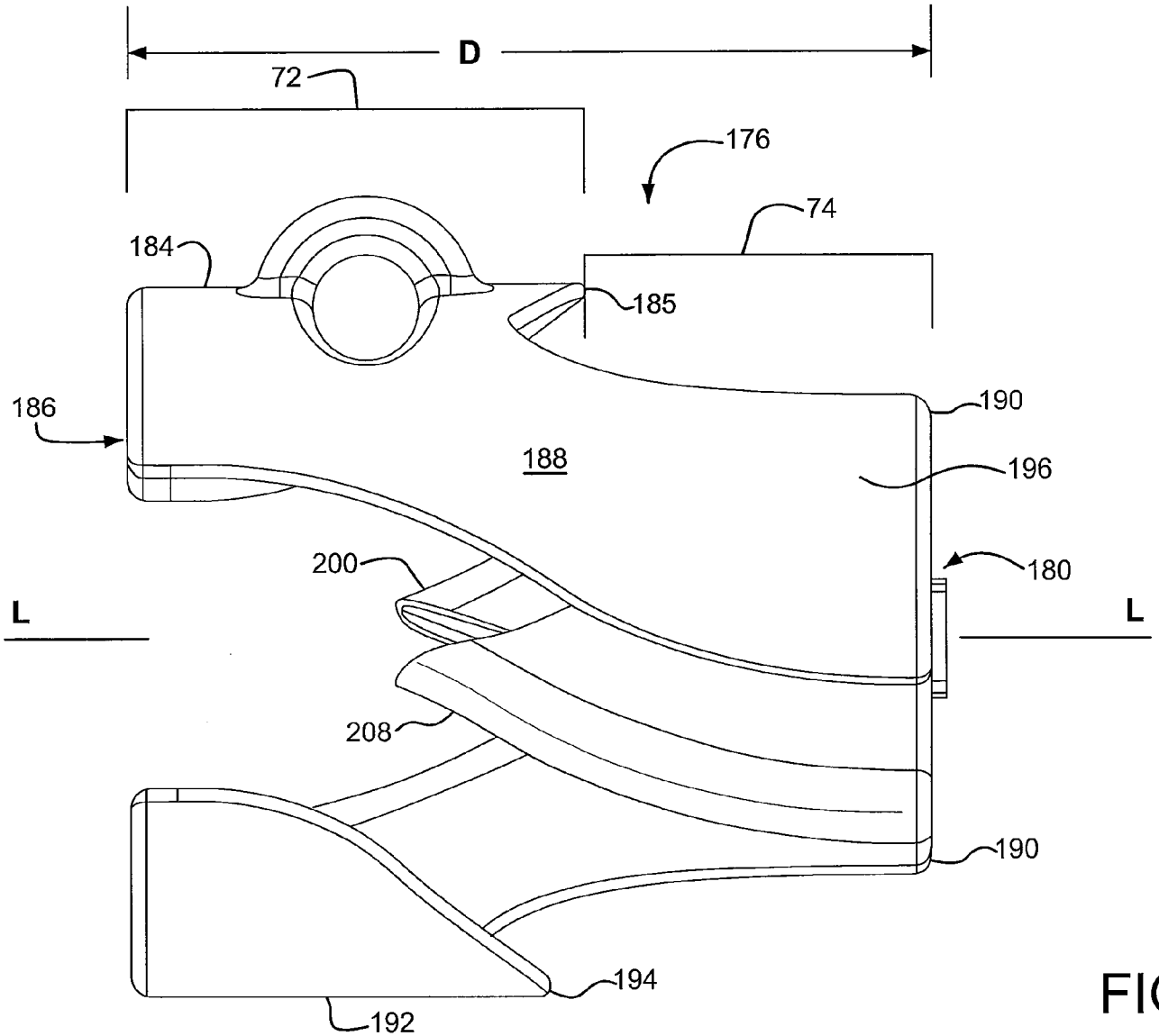

Referring now to FIGS. 44*a* and 44*b*, and in accordance with at least one embodiment of the present invention, a slider 176 is provided for use with upper and lower seal members 12 and 14, wherein, among other uses, the slider 176 is anticipated for use with a jacket, or other garment or item typically having a separated zipper type of closure mechanism. Accordingly, slider 176 is particularly suited for use with items wherein a minimal size slider is desirable. For slider 176, the opening portion 74 of the slider is separate from the closing portion 72. More particularly, for slider 176, the top 184 of the slider body 188 and the bottom 192 of the slider body 188 do not extend substantially into the opening portion 74. That is, in at least one embodiment, a top front edge 185 of the top 184 is located behind or longitudinally to the rear of a front edge 190 of intermediate lateral member 196. In addition, in at least one embodiment, the bottom front edge 194 of the bottom 192 is also located behind or longitudinally to the rear of a front edge 190 of intermediate lateral member 196. Thus, in accordance with embodiments of the present invention, at least one of the top front edge 185 and bottom front edge 194 are located behind or longitudinally to the rear of the front edge 190 of the intermediate lateral member 196. In addition, the top front edge 185 and bottom front edge 194 may be located at different longitudinally spaced apart distances from the front edge 190 of the intermediate lateral member 196. As shown in FIGS. 44*a* and 44*b*, the top front edge 185 and bottom front edge 194 are preferably situated between approximately 10 to 90 percent along the length D of the slider 176, and more preferably, between approximately 30 to 70 percent along the length D of slider 176, and more preferably yet, between about 40 to 60 percent along the length D of slider 176. Thus, in at least one embodiment, the slider 176 preferably includes an opening portion 74 having an intermediate lateral member 196 positioned between the top 184 and the bottom 192 of the slider body 188, and wherein the intermediate lateral member 196 is cantilevered from the closing portion 72 into the opening portion 74. The intermediate lateral member 196 acts as a wedge when opening the seal, by separating the upper seal member 12 from the lower seal member 14, and acts as a funneling guide when closing the seal. As a result of the configuration of slider 176, the sealing members 12 and 14 are exposed at the front 180 of the slider 176.

Figure 45A:
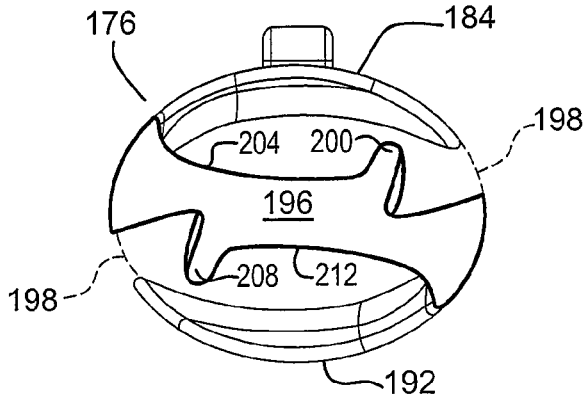
FIG. 45*a* is a front elevation view of the slider shown in FIGS. 44*a* and 44*b;*

Referring now to FIG. 45*a*, slider 176 has a somewhat flattened circular or oval shaped outline 198 (dashed) as viewed by passing a vertical plane though approximately a center portion of the slider 176, wherein the vertical plane is oriented substantially perpendicular to a longitudinal axis L-L of the slider 176. This structure adds stability to the slider 176 because of the slider's substantially balanced configuration. In addition, FIG. 45*a* illustrates that the intermediate lateral member 196 of slider 176 is preferably interconnected to the top 184 only along one lateral side of the intermediate lateral member 196, and is interconnected to the bottom 192 only along the other lateral side of the intermediate lateral member 196. Such configuration allows the upper and lower seal members 12 and 14 to extended in substantially opposite directions in the immediate vicinity of the slider 176.

Figure 45B:
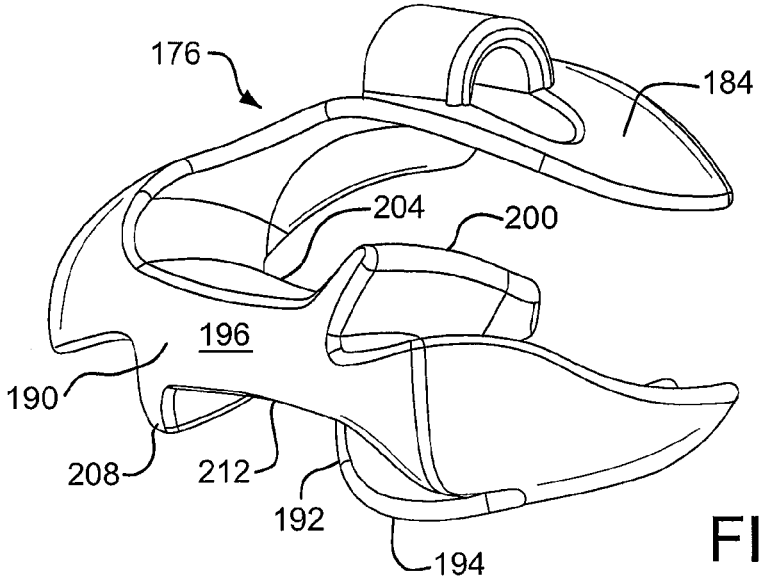
FIGS. 45*b* and 45*c* are perspective views of the slider shown in FIGS. 44*a* and 44*b;*
Figure 45C:
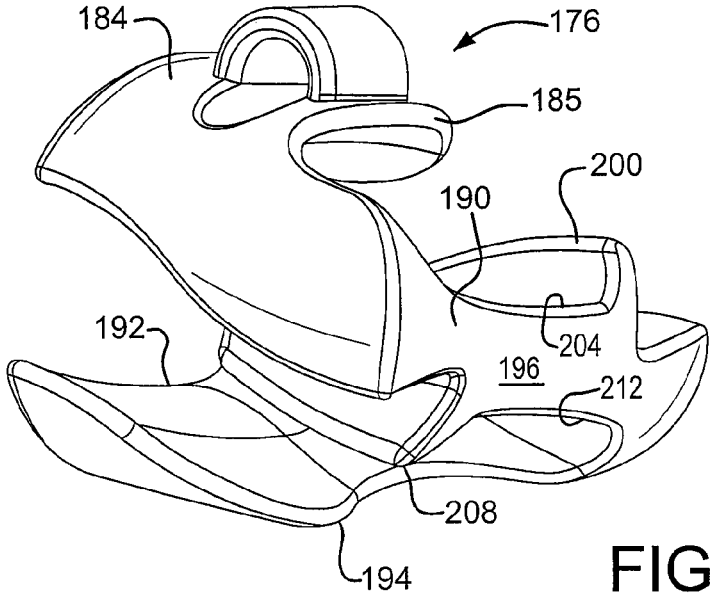

Referring to FIGS. 45*a*-45*c*, and in accordance with at least one embodiment of the present invention, the intermediate lateral member 196 may further comprise a total of one or more ribs, where such ribs, if present, preferably extend longitudinally along an upper and lower surface of the intermediate lateral member 196. More particularly, for the example slider 176 shown in FIGS. 45*a*-45*c*, an upper lateral member rib 200 extends from an upper surface 204 of the intermediate lateral member 196, and a lower lateral member rib 208 extends from a lower surface 212 of the intermediate lateral member 196. In accordance with embodiments of the present invention, the ribs 200, 208 may include a portion that is nearly or substantially vertically oriented, and may further include some curvature along their longitudinal length. The ribs 200 and 208 may be continuous or may include openings along their longitudinal length. Ribs 200 and 208 assist in aligning the mating surfaces 20, 22 of the sealing members 12 and 14, respectively, as the slider 176 is moved along the length of the seal, and also assist in maintaining proper tracking of the slider 176. It is to be understood that more than one rib may be located on each of the upper and/or lower surfaces 204, 212 of the intermediate lateral member 196. By way of example and not limitation, one rib could be used to coincide with each of the female mating shapes of the mating surfaces 20, 22 of the sealing members 12 and 14, respectively. In another alternative configuration, the slider 176 may not include any ribs.

Figure 46A:
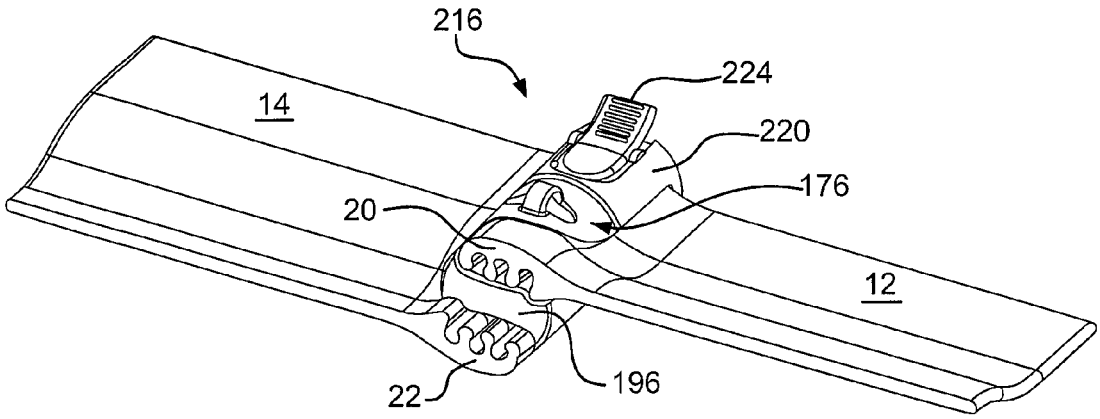
FIG. 46*a* is a perspective view of a sealing device in accordance with at least one embodiment of the present invention, the device including a beginning stop block.
Figure 46B:
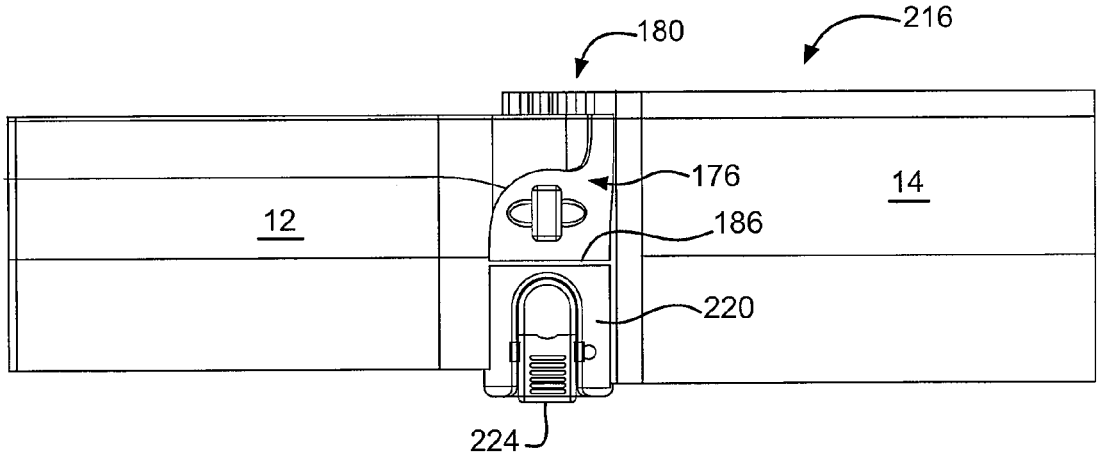
FIG. 46*b* is a plan view of the device shown in FIG. 46*a;*
Figure 47:
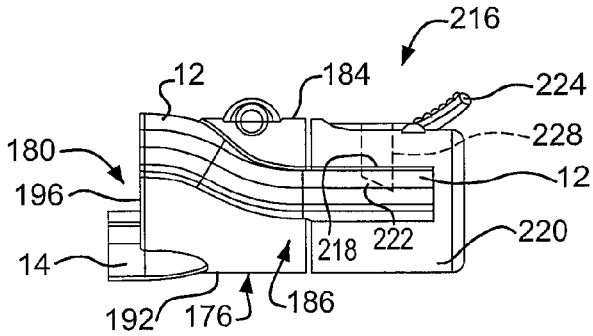
FIG. 47 is a side elevation view of the device shown in FIGS. 46*a* and 46*b;*

Referring now to FIGS. 46*a*, 46*b* and 47, and in accordance with at least one embodiment of the present invention, a sealing device 216 having a beginning stop block 220 is provided for use with a slider, such as slider 176, as well as upper and lower seal members 12 and 14. Among other uses, the sealing device 216 is anticipated for use with a jacket, or other garment or item, such as a sleeping bag, where it is desirable to be able to fully separate the first seal member 12 from the second seal member 14. It is further noted that certain materials used for the mating surfaces 20 and 22 of sealing members 12 and 14 can allow the two sealing members 12 and 14 to slide against one another. Accordingly, to prevent such slippage, a locking beginning stop block 220 can be used.

The beginning stop block 220 of sealing device 216 is preferably secured to one of either sealing members 12 and 14, and in a preferred embodiment, the beginning stop block 220 is secured to lower sealing member 14. The beginning stop block 220 includes a means for engaging the upper seal member 12. By way of example and not limitation, in at least one embodiment, the beginning stop block 220 includes a biased button 224 interconnected to a projection 228 for engaging a hole 218 located within the end portion of the upper seal member 12. In use, the slider 176 is positioned directly adjacent the beginning stop block 220, and then the upper seal member 12 is slid into the front 180 of the slider 176, which assists in routing the upper seal member 12 into the beginning stop block 220. The projection 228 then engages the hole 218 within the upper seal member 12 to releasably lock the upper seal member 12 into the beginning stop block 220. The bottom of the projection 228 preferably comprises a sloped surface 222 for smoothly engaging the hole 218, wherein the sloped surface 222 preferably slopes downward from the front to rear of the projection 228 (or downward from left to right as depicted in FIG. 47). After the upper seal member 12 is releasably locked into the beginning stop block 220, the slider 176 is moved down the length of the mating surfaces 20, 22 to form a seal between sealing members 12 and 14. To disengage the seal, the slider 176 moved toward the beginning stop block 220 until rear 186 of the slider 176 resides adjacent the beginning stop block 220, and then the back of the button 224 is depressed to lift the projection 228 from the hole 218 within the upper seal member 12, thereby allowing the upper seal member 12 to be slid out of the beginning stop block 220 and the slider 176.

Referring now to FIGS. 48*a*-48*g*, and in accordance with an alternate embodiment of the present invention, a sealing device 216' is provided, the device having a beginning stop block 220' that utilizes an alternate means for holding the upper sealing member 12 after it is inserted into the beginning stop block 220'. More particularly, in contrast to the beginning stop block 220 previously described that uses a biased projection to secure the upper sealing member 12 using a hole 218 in the upper sealing member 12, the beginning stop block 220' preferably comprises mechanism for gripping or tensioning the upper seal member 12 to hold the upper sealing member with the beginning stop block 220'.

Figure 48A:
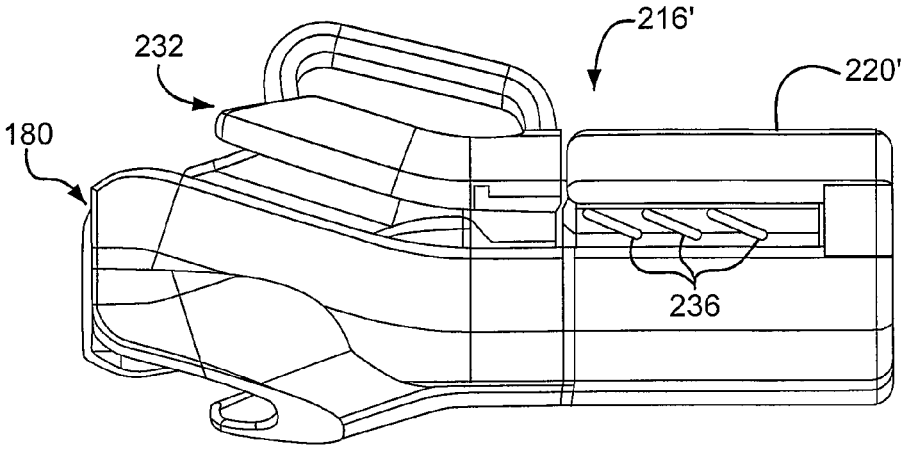
FIG. 48*a* is a side elevation view of another embodiment of a beginning stop block shown with an adjacent slider.
Figure 48B:
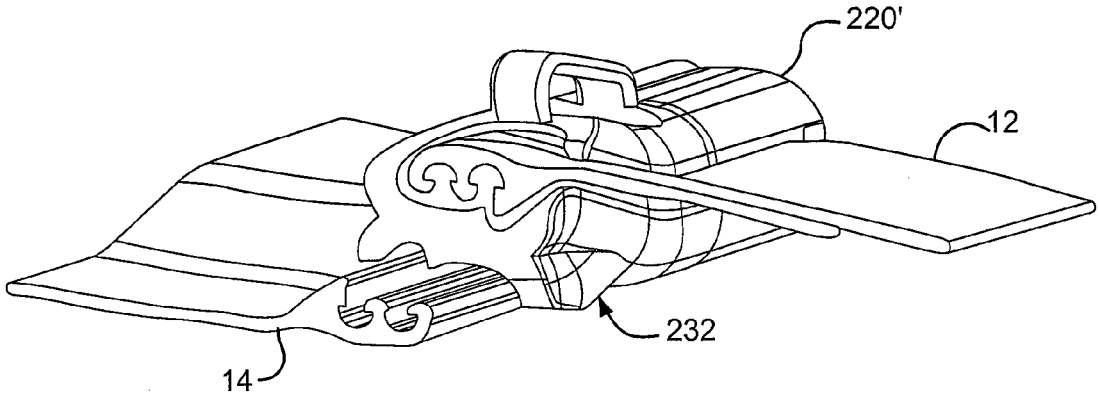
FIG. 48*b* is a front perspective view of the device shown in FIG. 48*a*, together with upper and lower sealing members.
Figure 48C:
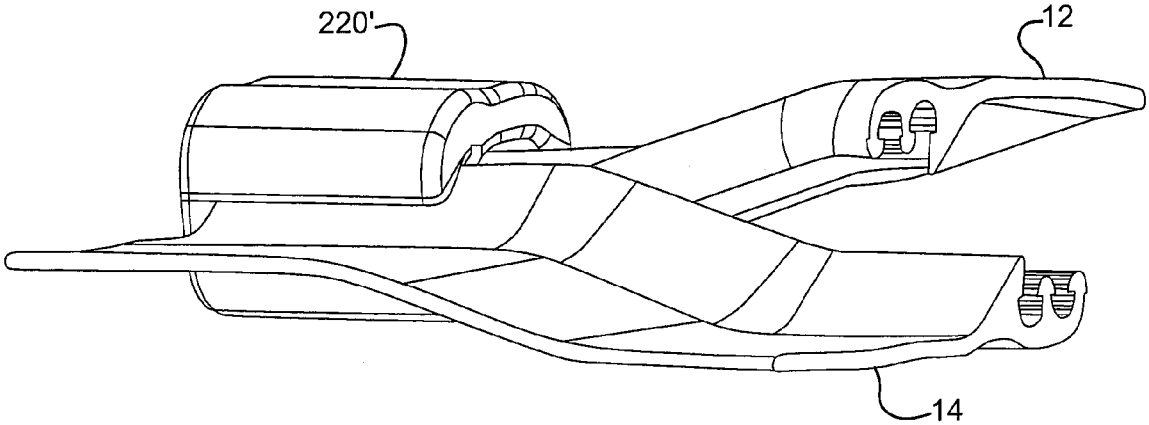
FIG. 48*c* is a side perspective view of the beginning stop block portion of FIGS. 48*a* and 48*b*, together with the upper and lower sealing members, but without the slider.
Figure 48D:
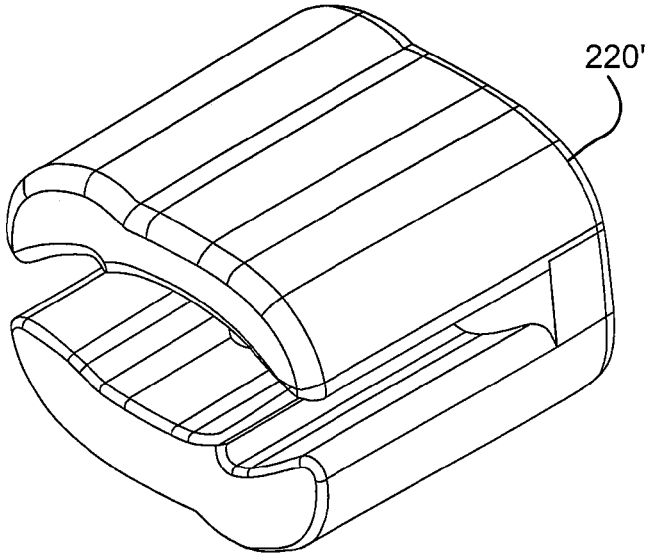
FIG. 48*d* is a perspective view of the beginning stop block shown in FIG. 48*c* without the sealing members.
Figure 48E:
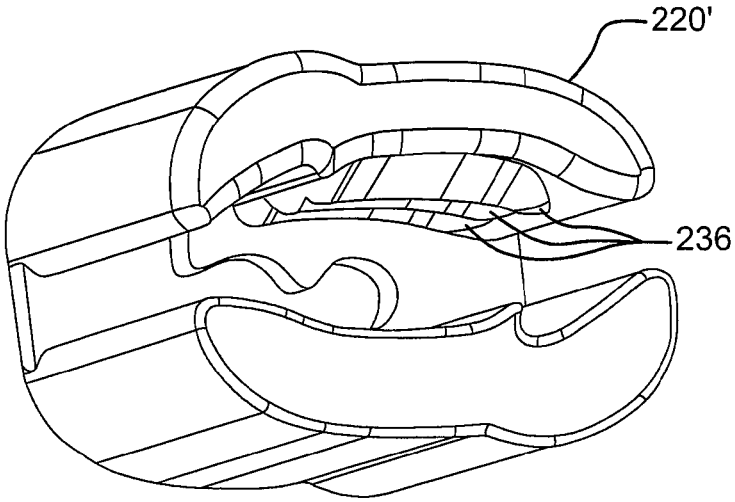
FIGS. 48*e* and 48*f* are perspective views of the beginning stop block shown in FIG. 48*d;*
Figure 48F:
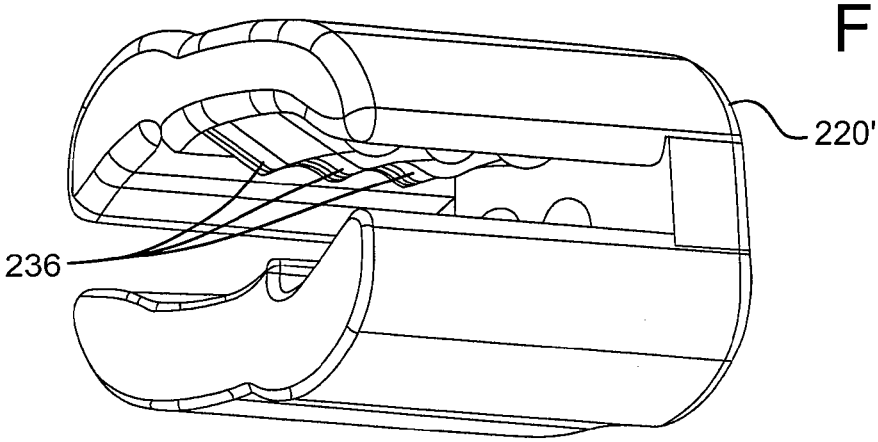
Figure 48G:
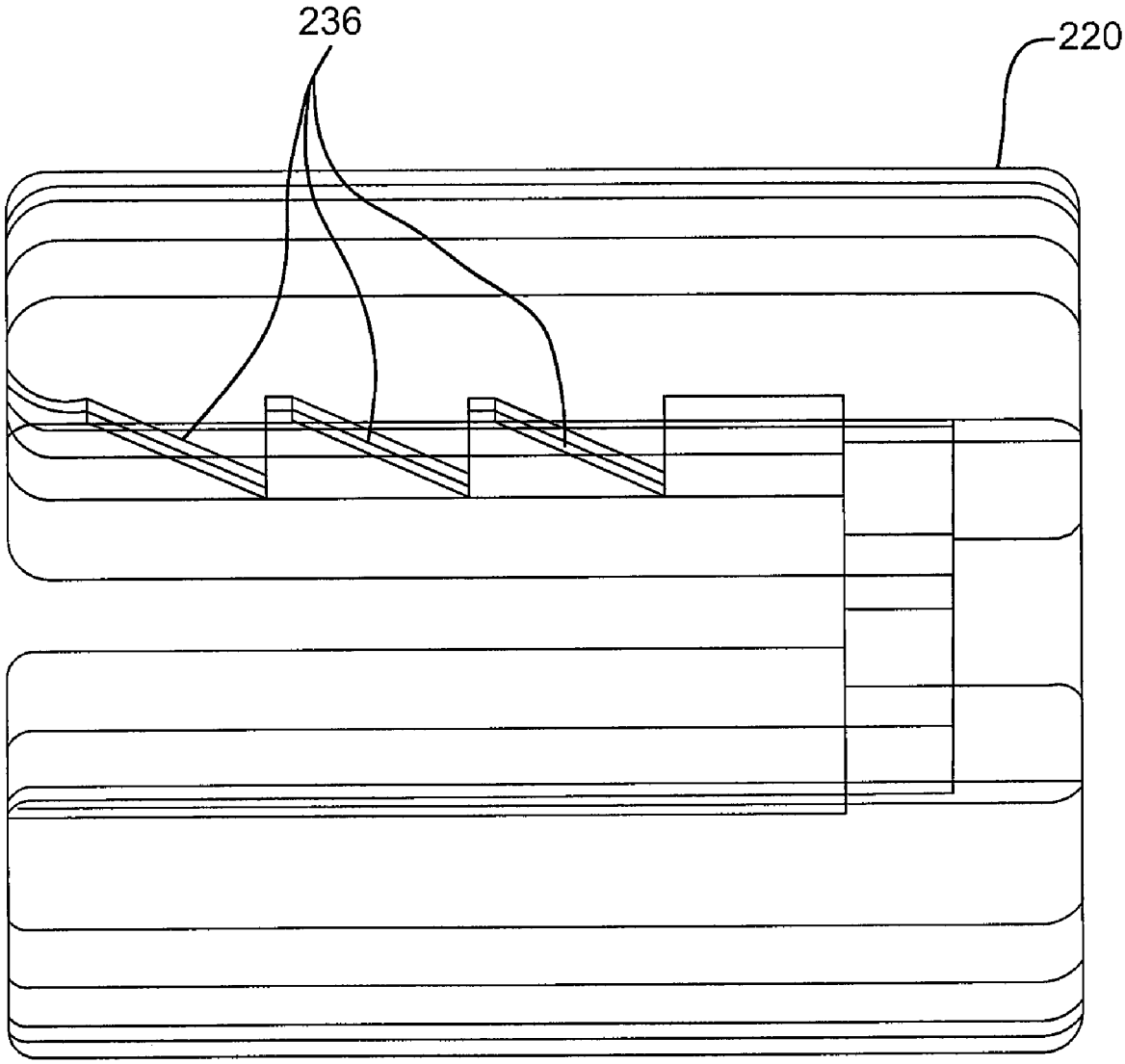
FIG. 48*g* is a side view of the device shown in FIG. 48*d* with some hidden structural features shown in phantom.
Figure 49:
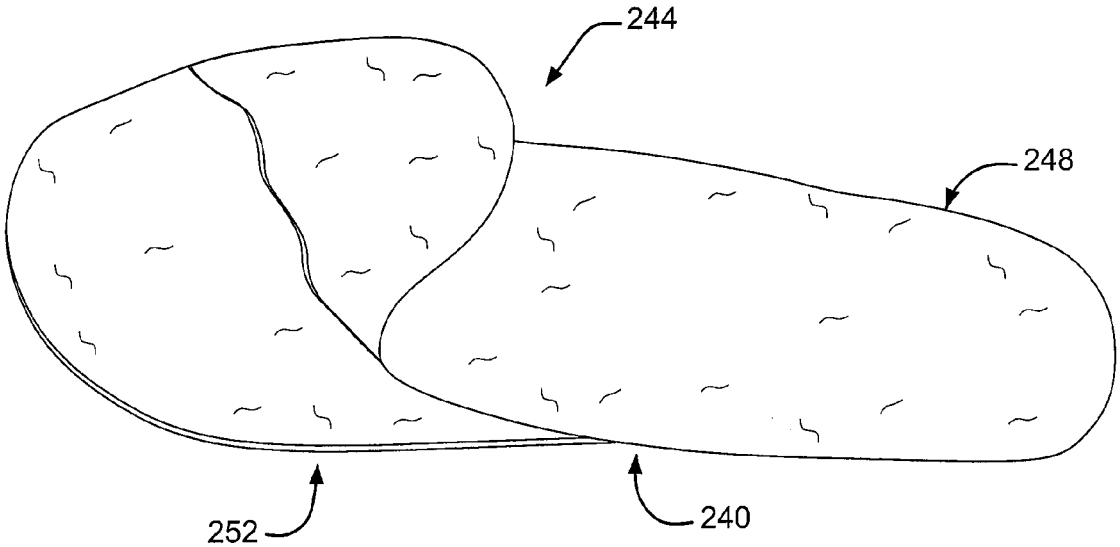
FIG. 49 is a sleeping bag comprising a breakaway sealing device in accordance with embodiments of the present invention.

FIG. 48*a* illustrates the beginning stop block 220' and a slider 232 located adjacent the beginning stop block 220'. The beginning stop block 220' allows the upper sealing member 12 to be inserted through the front 180 of the slider 232, as a user would typically do when using a normal zipper system. However, instead of engaging a small projection as described for foregoing beginning stop block 220, the upper sealing member 12 is held in place by a means for releasably securing or gripping that is operatively associated with the beginning stop block 220', where such means for gripping may include, but is not limited to, a series of grippers or scales 236 that grab the profile. As those skilled in the art will appreciate, there are many shape and size options for the scales 236, to include one or more of the structures such as biased projections, prongs, and a roughed surface, such as a bumps and/or a sand paper type surface. In general, the grippers or scales may be anything that will grab the upper sealing member 12 and hold it in place. As an alternate means of gripping the upper seal member, a small finger pump may be used to create a vacuum to hold the upper sealing member 12 to the beginning stop block 220'. Alternatively, the means for gripping may include one or more magnets. One such possible configuration comprises a small ferrous metal or magnet member connected to or integral with the end of the upper sealing member 12, with a complementary magnetically functioning member located within or operatively associated with the inside of the beginning stop block 220', wherein the magnetic forces are sufficient to hold the upper sealing member 12 properly in place.

Referring now to FIGS. 49-52, and in accordance with at least one embodiment of the present invention, a breakaway sealing device 240 is provided for use in an item that requires the user to quickly exit the item. Such a situation may exist, for example, when a soldier is bedded down in their sleeping bag and an enemy threat or emergency situation is realized. Under such circumstances, the soldier needs to be able to quickly exit their sleeping bag by breaking-away from the sleeping bag without being required to find the zipper pull. The breakaway sealing device 240 provides a means for sealing a sleeping bag 244, while still allowing the soldier to quickly exit the sleeping bag 244 as conditions may require.

The breakaway sealing device 240 preferably utilizes a separated block slider, such as previously described slider 176, wherein the slider 176 preferably includes one or more upper lateral member ribs 200 and lower lateral member ribs 208 extending from opposing sides of the intermediate lateral member 196. In addition, in one embodiment, the breakaway sealing device 240 further comprises an upper sealing member 12 that is slightly shorter than the lower sealing member 14, or alternatively, there exists a sufficient gap in the upper sealing member 12 to accommodate the slider 176. For such configurations, the slider 176 is able to completely disengage from the upper sealing member 12 in the vicinity of the cutaway portion or gap in the upper sealing member 12. It is to be understood that the slider 176 may alternatively disengage from the lower sealing member 14. This may be achieved by providing a shorter lower sealing member 14 than the upper sealing member 12, or by providing an lower sealing member 14 with a cutaway portion or gap, similar to that described herein for the upper sealing member. For purposes of explaining a preferred embodiment, the examples illustrated herein are directed to a slider 176 that disengages from the upper sealing member 12. When the slider 176 is disengaged from the upper sealing member 12, as shown in FIG. 52, the user can force the sealing members 12 and 14 apart and quickly exit the sleeping bag 244.

Figure 50:
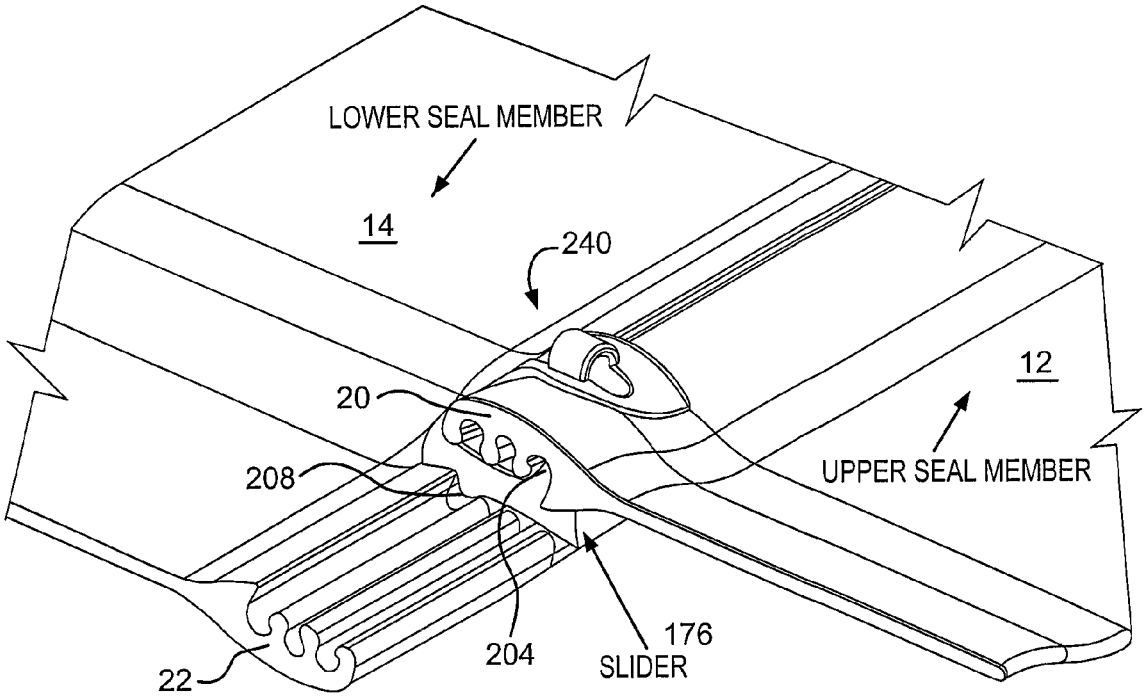
FIG. 50 is a perspective view of a breakaway sealing device in accordance with at least one embodiment of the invention.

In use, a user of the breakaway sealing device 240 is able to first close their sleeping bag 244 by routing the upper sealing member 12 into the slider 176 at the bottom 248 of their sleeping bag 244. This allows the user to then close their sleeping bag 244 when they move the slider 176 toward the top 252 of the sleeping bag 244. FIG. 50 illustrates the slider 176 at a position corresponding to the cut or shortened upper seal member 12 at the top 252 of the sleeping bag 244. As shown in FIG. 51, the slider 176 is advanced beyond the end of the upper seal member 12, such that the slider 176 only engages the lower seal member 14. As shown in FIG. 52, the user can then push on the upper layer of their sleeping bag, and the upper seal member 12 will disengage (with some appropriate amount of force) from lower seal member 14, thereby allowing the user to rapidly exit the sleeping bag 244 without using the slider 176. Upon returning to the sleeping bag 244, the user can then move the slider 176 along the lower seal member 14 back to the bottom 248 of the sleeping bag, route the upper seal member 12 back into the slider 176, and close their sleeping bag once again.

For the breakaway sealing device 240, the one or more upper and lower lateral member ribs 200 and 208 help keep the slider 176 on the track of the lower seal member 14 once the slider 176 has been extended beyond and disengaged from the upper seal member 12.

In accordance with embodiments of the present invention, and as seen in FIGS. 50-52, the mating surfaces 20 and 22 of the corresponding upper and lower sealing members 12 and 14, preferably comprise mating shapes having an hourglass configuration. Hourglass shaped mating shapes provide a sufficiently high contact surface area between the mating surfaces 20, 22, thereby providing an airtight and watertight closure along the length of the seal, and also providing enough shear strength to keep the seal closed during normal use, but also allowing the user to force the seal open with a reasonable amount of breakaway force. As those skilled in the art appreciate, it is to be understood that one or more different shapes and combinations thereof may be used and are within the scope of the present invention.

Figure 53:
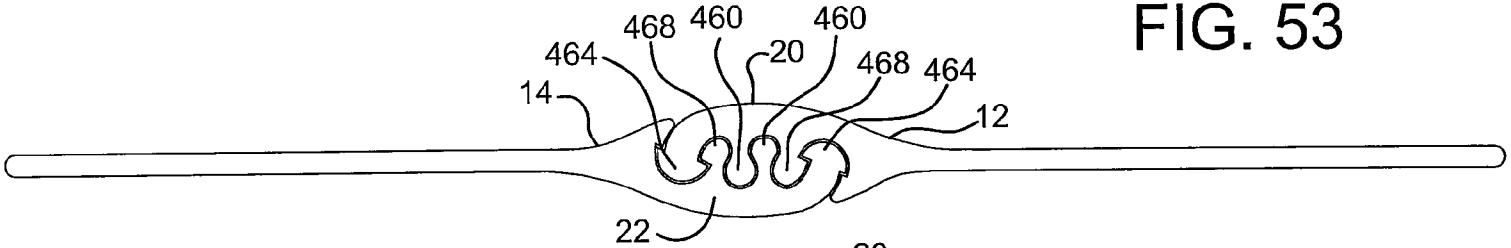
Figure 54:
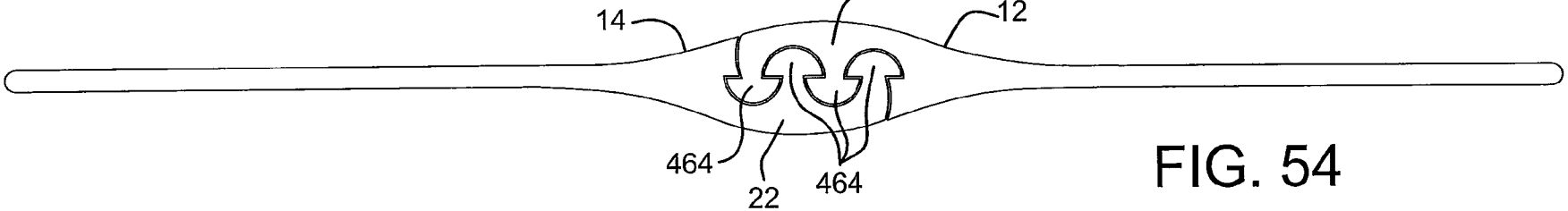

Referring now to FIGS. 53 and 54, and in accordance with embodiments of the present invention, an upper sealing member 12 is shown interlocking with lower sealing member 14, where the shape of both mating surfaces 20 and 22 of sealing members 12 and 14 is the same, and thus, a single sealing member is manufactured and used as both the upper and lower sealing members. Referring now to FIG. 53, the mating surfaces 20 and 22 include both hourglass-shaped male shapes 460 and mushroom-shaped male shapes 464. In addition, combination male shape 468 comprises a hourglass-shaped side and a mushroom-shaped side. The male shapes 460, 464 and 468 provide certain benefits when used alone, and when used in combination as shown in FIG. 53. More particularly, the combination of male shapes (and corresponding female shapes) is novel because: (1) the hourglass-shaped male shapes 460 have been found to provide significant sealing and thus resistance to the migration of certain gases; and (2) the mushroom-shaped male shapes 464 provide an appropriate mating (or interlocking) strength, while also having a rounded (and thus high surface area) top for good gas and water migration resistance. The combination male shape 468 allows the integration of adjacent hourglass-shaped male shapes 460 and mushroom-shaped male shapes 464, while also offering contribution to the interlocking strength and fluid migration resistance.

With reference now to FIG. 54, both the upper and lower seal members 12 and 14 include mating surfaces having only mushroom-shaped male shapes 464, thereby providing a seal with significant interlocking strength.

Figure 55:
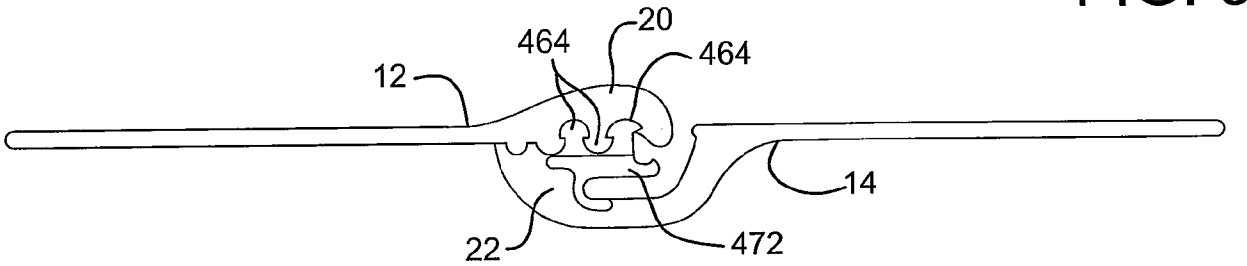
FIGS. 53-55 are side elevation views of upper an lower sealing members having mating surfaces with male and female shapes in accordance with embodiments of the present invention.

With reference now to FIG. 55, and in accordance with embodiments of the present invention, one or more of the seal members 12 and 14 may include different materials to provide superior structural and migration performance characteristics. By way of example and not limitation, two or more materials having different durometer values may be used to form portions of the sealing members 12 and 14, such as for portion 472 shown in FIG. 55. Such sealing members may be formed using a co-extrusion manufacturing process. It is to be understood that the male shapes may also comprise different materials as compared to the adjacent portions of the sealing members. For example, the hourglass-shaped male shapes 460 may comprise a lower durometer material than a neighboring co-extruded mushroom-shaped male shape 464.

Figure 56:
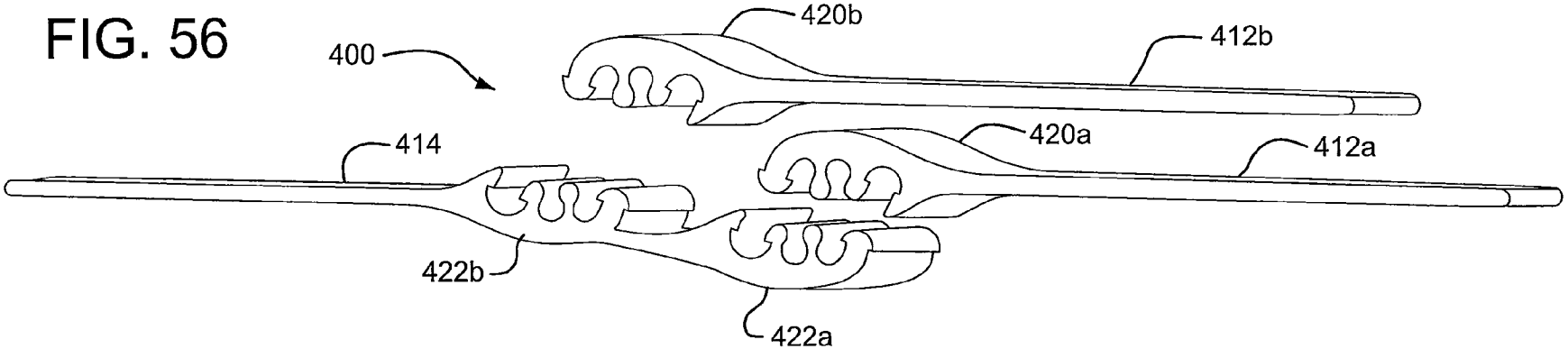
FIG. 56 is perspective view of a dual lower sealing member positioned proximate first and second upper sealing members, the various sealing members in accordance with embodiments of the present invention.
Figure 57:
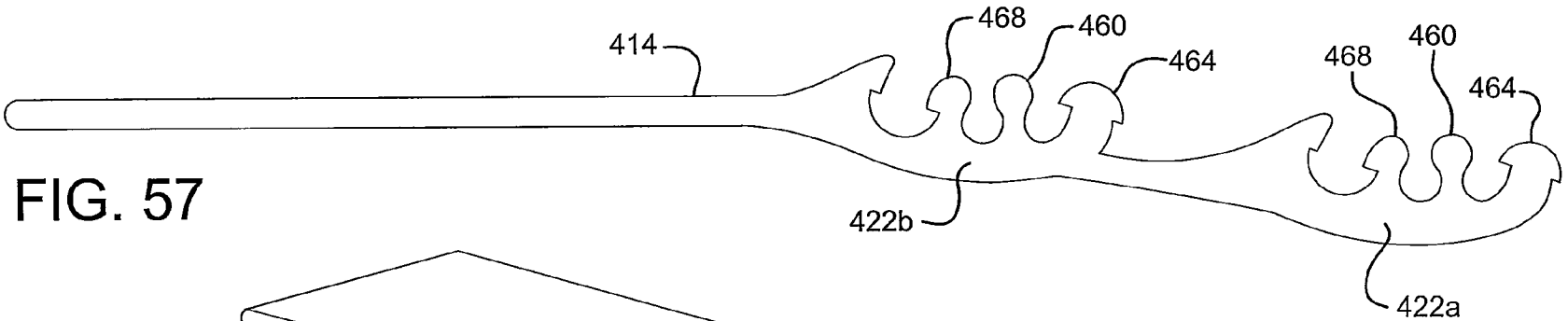
FIG. 57 is a side elevation view of the dual lower sealing member shown in FIG. 56.
Figure 58:
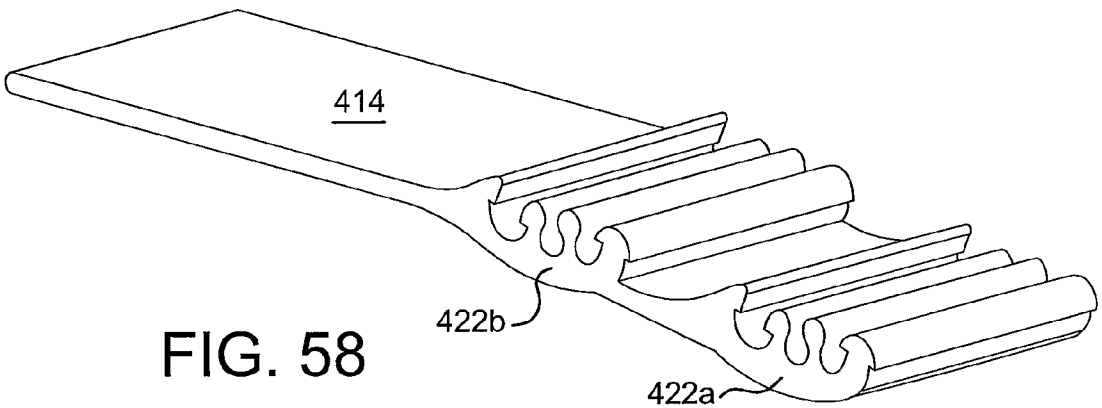
FIG. 58 is a perspective view of the device shown in FIG. 57.

Referring now to FIGS. 56-58, and in accordance with at least one embodiment of the present invention, a dual rail system 400 is provided, wherein the dual lower sealing member 414 includes two sets of mating surfaces 422*a* and 422*b*, and wherein the first mating surface 422*a* is spaced apart from the second mating surface 422*b*. The dual rail system 400 offers the advantage of allowing a single manufacturing step to produce a lower sealing member with two mating surfaces. This provides a cost advantage in manufacturing a sealing device for an item. By way of example and not limitation, many jackets include a zip-in liner so that an additional lining, such as a fleece layer, can be added to the jacket by the user to provide more warmth. In yet another example, a sleeping bag may include the ability for the user to zip on a bivy sack. By providing a dual rail system, the item can be made with reduced material costs, weight and bulk.

As shown in FIG. 56, the dual rail system 400 permits a first upper sealing member 412*a* to be coupled to the dual lower sealing member 414 by sealing mating surface 420*a* of the first upper sealing member 412*a* to a first mating surface 422*a* of the dual lower sealing member 414. In addition, the dual rail system 400 permits a second upper sealing member 412*b* to be coupled to the dual lower sealing member 414 by sealing mating surface 420*b* of the second upper sealing member 412*b* to a second mating surface 422*b* of the dual lower sealing member 414.

It is to be understood that the various sealing devices described herein may use one or more of any of the foregoing mating surfaces and male/female shapes, and/or combinations thereof, and such uses and possible combinations are within the scope of the present invention.

It is to be noted that the term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

While the above description and the drawings disclose and illustrate numerous alternative embodiments, one should understand, of course, that the invention is not limited to these embodiments. Those skilled in the art to which the invention pertains may make other modifications and other embodiments employing the principles of this invention, particularly upon considering the foregoing teachings. Therefore, by the appended claims, the applicant intends to cover any modifications and other embodiments.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance or achieving ease and/or reducing cost of implementation.

The foregoing discussion of the invention has been presented for purposes of illustration and description. The foregoing is not intended to limit the invention to the form or forms disclosed herein. In the foregoing Detailed Description, for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description Of The Invention, with each claim standing on its own as a separate preferred embodiment of the invention.

Moreover though the description of the invention has included description of one or more embodiments and certain variations and modifications, other variations and modifications are within the scope of the invention, e.g., as may be within the skill and knowledge of those skilled in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The invention claimed is:

1. A device for forming a continuous seal, comprising:

(a) a first seal member having a first mating surface;

(b) a second seal member having a second mating surface, wherein the second mating surface interlocks with the first mating surface; and (c) a slider moveable along the first and second seal members, wherein the slider circumscribes the seal members to interlock the first mating surface to the second mating surface, thereby forming the continuous seal, wherein said slider is movable along the entire length of the seal members and further wherein a portion of the first seal member includes a gap section, said gap section being located on a portion of the seal member wherein said slider is movable along, and wherein the slider comprises a curved shape substantially matching a curvature of the first and second seal members.

2. The device of claim 1, wherein a cross section of the continuous seal is substantially circular in shape.

3. The device of claim 1, wherein at least one of the first and second seal members is comprised of at least two different durometer materials.

4. A product, comprising the device of claim 1, wherein the product is selected from the group consisting of a hazardous material suit, fire suits, dry suits, dry bags, body bags, bivy sacks, waders, space suits, tents, shipping packages, household storage bags, map cases, chart cases, kayak skirts, backpack covers, computer cases, electronic device cases, watercraft containers, inflatable cases, flotation bags, flotation devices, waterproof pockets, fishing vest pockets, smellproof pockets, wetsuits, jackets, sleeping bags, rain gear, boots, kayak jackets, wind breakers, and wind proof fleeces.

5. A device for forming continuous closure, comprising:

(a) a first continuous closure member having a first mating surface;

(b) a second continuous closure member having a second mating surface, wherein the second mating surface interlocks with the first mating surface; and (c) means for circumscribing the closure members to interlock the first and second mating surfaces, thereby forming the continuous closure, wherein said means for circumscribing the closure members to interlock is movable along the entire length of the continuous closure members and further wherein a portion of the first closure member includes a gap section, said gap section being located on a portion of the closure member wherein said means for circumscribing the closure member is movable along, wherein the means for circumscribing comprises a slider, and wherein the slider comprises a curved shape substantially matching a curvature of the first and second continuous closure members.

6. The device of claim 5, wherein the continuous closure comprises at least one of (a) a gas migration resistant closure; (b) an air tight closure; (c) a water resistant closure; (d) a water proof closure; (e) a fluid permeable closure; and (f) a gas permeable closure.

* * * * *